US010973310B2

(12) United States Patent
Vlassis et al.

(10) Patent No.: US 10,973,310 B2
(45) Date of Patent: Apr. 13, 2021

(54) KITS, ASSEMBLIES AND COMPONENTS FOR USE IN POSITIONING A DEVICE, METHODS OF POSITIONING A DEVICE, AND POSITIONED DEVICES

(71) Applicants: James M. Vlassis, Manlius, NY (US); Racquel M. Vlassis, Manlius, NY (US); Isabella M. Vlassis, Manlius, NY (US); Dean J. Vlassis, Manlius, NY (US); Benito R. Vlassis, Manlius, NY (US); Giselle R. Vlassis, Manlius, NY (US)

(72) Inventors: James M. Vlassis, Manlius, NY (US); Racquel M. Vlassis, Manlius, NY (US); Isabella M. Vlassis, Manlius, NY (US); Dean J. Vlassis, Manlius, NY (US); Benito R. Vlassis, Manlius, NY (US); Giselle R. Vlassis, Manlius, NY (US)

( * ) Notice: Subject to any disclaimer, the term of this patent is extended or adjusted under 35 U.S.C. 154(b) by 120 days.

(21) Appl. No.: 15/974,244

(22) Filed: May 8, 2018

(65) Prior Publication Data

US 2018/0325249 A1 Nov. 15, 2018

Related U.S. Application Data

(63) Continuation-in-part of application No. 15/591,586, filed on May 10, 2017, now abandoned.

(51) Int. Cl.

| | |
|---|---|
| ***A45F 5/02*** | (2006.01) |
| ***A45F 3/14*** | (2006.01) |
| *A45F 5/00* | (2006.01) |

(52) U.S. Cl.

CPC ..... *A45F 5/022* (2013.01); *A45F 3/14* (2013.01); *A45F 5/021* (2013.01); (Continued)

(58) Field of Classification Search

CPC ..... H01F 7/0263; H05K 5/02; H05K 5/0204; H04M 1/00; A44C 3/00; A45F 5/022; (Continued)

(56) References Cited

U.S. PATENT DOCUMENTS

| | | | |
|---|---|---|---|
| 4,236,331 | A | 12/1980 | Mattson |
| 4,457,425 | A | 7/1984 | Cooper et al. |

(Continued)

OTHER PUBLICATIONS

U.S. Appl. No. 15/591,586, filed May 10, 2017, Vlassis et al.

(Continued)

*Primary Examiner* — Brian D Nash
(74) *Attorney, Agent, or Firm* — Burr & Brown, PLLC

(57) ABSTRACT

Kits, assemblies and components for positioning a device, methods of positioning a device, positioned devices. In some aspects, a device is an electronic device, a smart phone or a camera. A representative method comprises adhering at least a first attachment element (suction element and/or releasable adhesive material) of an attachment assembly (comprising the first attachment element and a first interface element (at least one magnetic element and/or at least one magnet-adhering element)) to a first surface, and magnetically adhering a device assembly (comprising a first magnet-adhering element and a device) to the attachment assembly, the first interface element attached to the first attachment element, the device attached to the first magnet-adhering element. A representative positioned device comprises a device attached to a first magnet-adhering element which is magnetically adhered to a magnetic element (which is attached to an attachment element that is adhered to a first surface.

2 Claims, 25 Drawing Sheets

(52) U.S. Cl.
CPC ... *A45F 2003/142* (2013.01); *A45F 2005/002* (2013.01); *A45F 2005/025* (2013.01); *A45F 2200/0516* (2013.01); *A45F 2200/0533* (2013.01)

(58) Field of Classification Search
CPC ..... A45F 3/14; A45F 2003/142; A45F 2005/002; A45F 2005/025; A45F 2200/0516; A45F 2200/0533
See application file for complete search history.

(56) References Cited

U.S. PATENT DOCUMENTS

| | | | | |
|---|---|---|---|---|
| 4,528,726 | A * | 7/1985 | Kurashima | A44B 5/00 24/102 SL |
| 4,736,494 | A * | 4/1988 | Marchesi | A41F 1/002 24/303 |
| 5,369,899 | A | 12/1994 | Reeves | |
| 6,888,940 | B1 | 5/2005 | Deppen | |
| 7,610,868 | B2 | 11/2009 | Gardner | |
| 7,690,542 | B1 | 4/2010 | Silvera | |
| 7,810,683 | B2 | 10/2010 | Chan | |
| 8,328,055 | B1 * | 12/2012 | Snyder | A45F 5/00 224/197 |
| 8,345,412 | B2 | 1/2013 | Maravilla et al. | |
| 8,418,900 | B1 | 4/2013 | Baker | |
| 8,464,377 | B1 | 6/2013 | Carson et al. | |
| 8,573,458 | B1 | 11/2013 | Hamilton | |
| 8,662,362 | B1 * | 3/2014 | Bastian | H04B 1/3888 224/197 |
| 8,667,650 | B1 | 3/2014 | Duffin | |
| 8,776,327 | B2 | 7/2014 | Wein et al. | |
| 8,936,222 | B1 | 1/2015 | Bastian et al. | |
| 9,033,199 | B2 | 5/2015 | Weber | |
| 9,427,070 | B1 | 8/2016 | Bastian et al. | |
| 9,433,257 | B2 | 9/2016 | Taetzsch | |
| 9,717,293 | B2 | 8/2017 | Lim | |
| 9,746,299 | B1 * | 8/2017 | Davis | F42B 39/02 |
| 10,109,175 | B2 * | 10/2018 | Roberts et al. | G08B 21/0423 |
| 10,226,092 | B1 * | 3/2019 | Parker | A41F 1/00 |
| 10,237,384 | B2 * | 3/2019 | Holder | H04M 1/04 |
| 2001/0035445 | A1 * | 11/2001 | Kamiya | A45F 5/02 224/271 |
| 2003/0000976 | A1 * | 1/2003 | Malhotra | A45F 5/00 224/197 |
| 2003/0019893 | A1 | 1/2003 | Decoteau | |
| 2005/0082323 | A1 * | 4/2005 | O'Hair | B25H 3/00 224/219 |
| 2005/0102802 | A1 | 5/2005 | Sitbon et al. | |
| 2005/0184117 | A1 | 8/2005 | Brown | |
| 2005/0198872 | A1 | 9/2005 | Correa | |
| 2007/0012733 | A1 | 1/2007 | Horito et al. | |
| 2008/0223889 | A1 | 9/2008 | Rossell et al. | |
| 2009/0289090 | A1 | 11/2009 | Fullerton et al. | |
| 2010/0242230 | A1 * | 9/2010 | Cohen | A44B 5/02 24/41.1 |
| 2013/0119098 | A1 | 5/2013 | Stiefel | |
| 2014/0042294 | A1 | 2/2014 | Marzynski et al. | |
| 2014/0130228 | A1 * | 5/2014 | Horton | A41B 1/10 2/69 |
| 2014/0159840 | A1 | 6/2014 | Qadri | |
| 2014/0182088 | A1 | 7/2014 | Roberts et al. | |
| 2014/0259298 | A1 | 9/2014 | Esagoff | |
| 2015/0216276 | A1 | 8/2015 | Stratton | |
| 2015/0250269 | A1 * | 9/2015 | Tang | A41D 27/08 24/303 |
| 2015/0366297 | A1 | 12/2015 | Taetzsch | |
| 2016/0003269 | A1 | 1/2016 | Russell-Clarke et al. | |
| 2016/0242534 | A1 | 8/2016 | Mathieu | |
| 2018/0078023 | A1 | 3/2018 | Kim et al. | |
| 2018/0325247 | A1 * | 11/2018 | Vlassis | A45C 13/1069 |

OTHER PUBLICATIONS

Promotional Cell Phone Stands, 4AllPromos, printout from http://www.4allpromos.com/category/cell-phone-stands?&mkwid—saNgrLAWo . . . , Sep. 26, 2016, pp. 1-11.
Promotional Cell Phone Stands, 4AllPromos, printout from http://www.4allpromos.com/category/cell-phone-stands?page=l&mkwid=saNgrLAWo%7 . . . , Sep. 26, 2016, pp. 1-11.
Promotional Cell Phone Stands, 4AllPromos, printout from http://www.4allpromos.com/category/cell-phone-stands?page=2&mkwid=saNgrLAWo%7 . . . , Sep. 26, 2016, pp. 1-2.
Apple iPhone 6 Phone Holders, Holster & Belt Clips, Cellular Outfitter, printout from http://www.cellularoutfitter.com/apple/iphone-6/phone-holders-holsters-belt-clips.html, Sep. 26, 2016, p. 1-13.
Cell Phone Holder, Stand, Mounts & More—Newegg.com, printout from http://www.newegg.com/Mounts-Holders/SubCategory/ID-2957/Page-2?PageSize=36&or . . . , Sep. 26, 2016, pp. 1-10.
Cell Phone Holder, Stand, Mounts & More—Newegg.com, printout from http://www.newegg.com/Mounts-Holders/SubCategory/ID-2957/Page-3?PageSize=36&or . . . , Sep. 26, 2016. pp. 1-9.
International Preliminary Report and the Written Opinion of the International Searching Authority from a corresponding international patent application (PCT/US2018/031798) dated Nov. 21, 2019, 9 pages.
International Search Report and the Written Opinion of the International Searching Authority from a corresponding international patent application dated Aug. 31, 2018, 13 pages.

* cited by examiner

KITS, ASSEMBLIES AND COMPONENTS FOR USE IN POSITIONING A DEVICE, METHODS OF POSITIONING A DEVICE, AND POSITIONED DEVICES

CROSS-REFERENCE TO RELATED APPLICATIONS

This application is a continuation-in-part of U.S. patent application Ser. No. 15/591,586, filed May 10, 2017, the entirety of which is incorporated herein by reference.

FIELD OF THE INVENTIVE SUBJECT MATTER

The present inventive subject matter relates to kits, assemblies and components that can be used to position a device, methods of positioning a device, and positioned devices. In some aspects, the present inventive subject matter relates to kits, assemblies and components that can be used to position an electronic device, such as a smart phone or a camera, and other aspects relate to methods of positioning such a device, or such devices held in place.

BACKGROUND

Smart phones and digital cameras (including those built into smart phone as well as devices that include or consist of digital cameras but are not part of smart phones) are ubiquitous. In addition, there are a wide array of other devices (electronic devices, non-electronic devices and devices that are combinations of electronic and non-electronic components and/or systems), new devices are being introduced, and existing devices are being developed and/or enhanced. It is likely that this trend will continue, and possibly accelerate, as time passes, resulting in the desire (or need) to store, manipulate and/or run such devices (and potentially combinations, possibly complex combinations, of such devices).

BRIEF SUMMARY OF THE INVENTIVE SUBJECT MATTER

There are many situations where there is a need or desire to hold a device in place.

A representative example is where a healthcare professional (or any other person) wants to secure a device, e.g., a smart phone (or other device, e.g., any electronic device, such as a medical device or a dental device) in a first position relative to his or her body.

By way of illustration, taking the example of a smart phone (and recognizing that instead of a smart phone, this discussion could involve any other device), the person might have a need or desire to hold the smart phone in the first position relative to his or her body, and (1) be able to rapidly remove the smart phone from the first position to take the smart phone in his or her hand and have the smart phone be freely movable, i.e., movable in any direction and/or rotatable to any orientation, and be able to rapidly secure the smart phone back in the first position relative to his or her body (such that the smart phone can again be rapidly removed from the first position and again taken in his or her hand and be freely movable, i.e., movable in any direction and/or rotatable to any orientation), and/or (2) be able to use the smart phone without holding the smart phone in his or her hand. The ability to use the smart phone includes a wide range of activities, including:

- communicating using the smart phone, e.g., transmitting content or information using the smart phone, e.g., transmitting sound and/or images (e.g., speaking into the smart phone, singing into the smart phone, emitting other sounds into the smart phone, creating sounds in the smart phone, e.g., with an ap, a game, from a website, etc.;
- picking up ambient sound (e.g., another person or persons speaking, singing or emitting other sounds, an alarm, a concert, sounds created by nature);
- playing recorded sound into or by the smart phone;
- taking, storing and/or transmitting photographs (e.g., transmitting photographs stored in the smart phone, transmitting images being viewed in real time, or accessing content from another source);
- taking, storing and/or transmitting video or time-lapse video (e.g., transmitting video stored in the smart phone, transmitting video in real time or accessing content from another source);
- receiving content or information using the smart phone, e.g., receiving sound and/or images (e.g., receiving content or information described above as being taken or transmitted); and
- shining a flashlight built into the smart phone, and any combinations thereof, e.g., sending and/or receiving sound and/or images, using any functionality (e.g., FaceTime®, live streaming, etc.).

As noted above, the description in the preceding paragraph relates to smart phones, but the concept of having the ability to store (with rapid access and return), hold in position and operate (with free hands), and/or hold in position and view (again, with free hands) is applicable to a wide variety of devices.

By way of another illustration, taking the example of a camera, a person might have a need or desire to hold the camera (for taking photographs and/or videos) in a first position relative to his or her body, and (1) be able to rapidly remove the camera from the first position to take the camera in his or her hand and be freely movable, i.e., movable in any direction and/or rotatable to any orientation, and be able to rapidly secure the camera back in the first position relative to his or her body (such that the camera can again be rapidly removed from the first position and again taken in his or her hand and be freely movable, i.e., movable in any direction and/or rotatable to any orientation), and/or (2) be able to use the camera without holding the camera in his or her hand (leaving his or her hands free for other activity, e.g., while skiing, skateboarding, hang-gliding, sailing, etc.), and/or (3) be able to view a screen on his or her camera.

Having the ability to use a device in any way (including but not limited to the uses described above) without having to hold the device in his or her hand can allow the user to use his or her hands to perform other activities (i.e., to have his or her hands free), and/or can reduce the risk of the device being lost or damaged (e.g., by deliberately or unconsciously setting the device down, e.g., when a free hand is needed), and/or, in some cases (optionally), to more precisely hold the device. For example, in some instances, having the ability to use a device without having to hold the device in his or her hand can allow the user to have his or her hands free while performing an activity or including friends and family in events in which he or she is participating; likewise, having the ability to use a device without having to hold the device in his or her hand can allow the user to talk hands-free while driving (while keeping the device (e.g., smart phone) on the user's body, and with a lower risk of the device getting lost or forgotten); having the ability to use a camera (or other device that comprises a camera) without having to hold the camera (or other device) in his or her hand can allow the user to film while engaging in activities that normally require the use of both hands (or to engage in activities that can be done more effectively or comfortably without having one or both hands on the camera or other device); having the ability to use a device without having to hold the device in his or her hand can allow the user to reduce or avoid the risk (or tendency) of deliberately or unconsciously setting down the device (e.g., a smart phone), thereby avoiding or reducing the risk of the device (i) falling, accelerating and landing on a hard surface, (ii) falling into a liquid (e.g., a toilet), (iii) having something spilled on the device, (iv) losing the device, etc.; having the ability to use a device without having to hold the device in his or her hand can allow the user to have both hands free (e.g., to dance) while listening to music; having the ability to use a device without having to hold the device in his or her hand can provide the user with an alternative to storing the device in his or her pocket (in many cases, newer smart phones are larger and more cumbersome than older smart phones); having the ability to use a device without having to hold the device in his or her hand can allow the user to use the device as a flashlight, e.g., while walking at night or going into a dark room or attic, and using both hands to navigate, carry items, etc.

The present inventive subject matter provides kits, assemblies, components, methods and positioned devices that provide improved capabilities for satisfying the needs and/or capabilities as discussed above.

In accordance with a first aspect of the present inventive subject matter, there is provided a method of positioning a device, comprising:

placing at least a first magnetic element in a pocket in an article of clothing, and magnetically adhering to the first magnetic element at least a first magnet-adhering element to which a device is attached.

In some embodiments of methods in accordance with the first aspect of the present inventive subject matter, upon said "magnetically adhering to the first magnetic element at least a first magnet-adhering element to which a device is attached," a first region of the article of clothing is between the first magnetic element and the first magnet-adhering element.

In accordance with a second aspect of the present inventive subject matter, there is provided a method of positioning a device, comprising:

magnetically adhering at least a first magnetic element to a second magnetic element with a first region of an article of clothing between the first magnetic element and the second magnetic element, magnetically adhering to the first magnetic element at least a first magnet-adhering element to which a device is attached.

In some embodiments of methods in accordance with the second aspect of the present inventive subject matter, the method further comprises placing the second magnetic element in a pocket in the article of clothing prior to said "magnetically adhering at least a first magnetic element to a second magnetic element."

In accordance with a third aspect of the present inventive subject matter, there is provided a method of positioning a device, comprising:

magnetically adhering at least a first magnetic element to a first magnet-adhering element with a first region of an article of clothing between the first magnetic element and the first magnet-adhering element; and magnetically adhering to the first magnetic element at least a second magnet-adhering element to which a device is attached.

In some embodiments of methods in accordance with the third aspect of the present inventive subject matter, the method further comprises placing the first magnet-adhering element in a pocket in the article of clothing prior to said magnetically adhering at least said first magnetic element to said first magnet-adhering element.

In accordance with a fourth aspect of the present inventive subject matter, there is provided a kit for providing a device magnetically held in place, the kit comprising:

at least a first magnetic element;

a device; and at least a first magnet-adhering element, the device attached to the first magnet-adhering element.

In some embodiments of kits in accordance with the fourth aspect of the present inventive subject matter, the kit further comprises at least a second magnetic element.

In some embodiments of kits in accordance with the fourth aspect of the present inventive subject matter, the kit further comprises at least a second magnet-adhering element.

In some embodiments of kits in accordance with the fourth aspect of the present inventive subject matter, the kit further comprises at least a second magnetic element and at least a second magnet-adhering element.

In accordance with a fifth aspect of the present inventive subject matter, there is provided a positioned device, comprising:

at least a first magnetic element;

a device; and at least a first magnet-adhering element, the device attached to the first magnet-adhering element, the first magnet-adhering element magnetically adhered to the at least a first magnetic element.

In some embodiments of positioned devices in accordance with the fifth aspect of the present inventive subject matter:

the positioned device further comprises a second magnetic element, the second magnetic element is magnetically adhered to the at least a first magnetic element.

In some embodiments of positioned devices in accordance with the fifth aspect of the present inventive subject matter:

the positioned device further comprises a second magnetic element that is magnetically adhered to a first side of the first magnetic element, the first magnet-adhering element is adhered to a second side of the first magnetic element, and the first side of the first magnetic element and the second side of the first magnetic element are on opposite sides of the first magnetic element.

In accordance with a sixth aspect of the present inventive subject matter, there is provided a magnet-adhering device assembly, comprising:

a device;

a magnet-adhering element; and a friction-enhancing member, the magnet-adhering element attached to the device, the friction-enhancing member attached to the magnet-adhering element.

In some embodiments of magnet-adhering device assemblies in accordance with the sixth aspect of the present inventive subject matter, the friction-enhancing member extends around the magnet-adhering element and the device.

In accordance with a seventh aspect of the present inventive subject matter, there is provided a strap assembly, comprising:

a self-adhering strap; and at least a first magnet-adhering element, the first magnet-adhering element attached to the self-adhering strap.

In some embodiments of strap assemblies in accordance with the seventh aspect of the present inventive subject matter:

the self-adhering strap comprises a first adherence region and a second adherence region, the first adherence region is removably adherable to the second adherence region, and the spacing along the self-adhering strap between the first adherence region and the second adherence region (the measuring of said spacing being as described below) and/or the length of the first adherence region along the self-adhering strap and the length of the second adherence region along the self-adhering strap is/are selected based on the part of the body (and the extent to which the person or animal is full grown), as discussed below.

In accordance with an eighth aspect of the present inventive subject matter, there is provided a kit comprising a strap assembly in accordance with the seventh aspect of the present inventive subject matter, and at least a first magnetic element.

In accordance with a ninth aspect of the present inventive subject matter, there is provided a magnetically positioned magnet assembly, comprising a strap assembly in accordance with the seventh aspect of the present inventive subject matter, and at least a first magnetic element which is magnetically adhered to the first magnet-adhering element.

In accordance with a tenth aspect of the present inventive subject matter, there is provided a device assembly, comprising:

a magnetically positioned magnet assembly in accordance with the ninth aspect of the present inventive subject matter;

a second magnet-adhering element; and a device, the device attached to the second magnet-adhering element, the second magnet-adhering element magnetically adhered to the first magnetic element.

In accordance with an eleventh aspect of the present inventive subject matter, there is provided a strap assembly, comprising:

a self-adhering strap; and at least a first magnetic element, the first magnetic element attached to the self-adhering strap.

In some embodiments of strap assemblies in accordance with the eleventh aspect of the present inventive subject matter:

the self-adhering strap comprises a first adherence region and a second adherence region, the first adherence region is removably adherable to the second adherence region, and the spacing along the self-adhering strap between the first adherence region and the second adherence region (the measuring of said spacing being as described below) and/or the length of the first adherence region along the self-adhering strap and the length of the second adherence region along the self-adhering strap is/are selected based on the part of the body (and the extent to which the person or animal is full grown), as discussed below.

In accordance with a twelfth aspect of the present inventive subject matter, there is provided a device assembly, comprising:

a strap assembly in accordance with the eleventh aspect of the present inventive subject matter;

at least a first magnet-adhering element; and a device, the device attached to the first magnet-adhering element, the first magnet-adhering element magnetically adhered to the first magnetic element.

In accordance with a thirteenth aspect of the present inventive subject matter, there is provided a body-engaging assembly, comprising:

a body-engaging element; and at least a first magnet-adhering element, the first magnet-adhering element attached to the body-engaging element.

In accordance with a fourteenth aspect of the present inventive subject matter, there is provided a kit comprising:

a body-engaging assembly in accordance with the thirteenth aspect of the present inventive subject matter; and at least a first magnetic element.

In accordance with a fifteenth aspect of the present inventive subject matter, there is provided a magnetically positioned magnet assembly, comprising:

a body-engaging assembly in accordance with the thirteenth aspect of the present inventive subject matter; and at least a first magnetic element, the first magnetic element magnetically adhered to the first magnet-adhering element.

In accordance with a sixteenth aspect of the present inventive subject matter, there is provided a device assembly, comprising:

a magnetically positioned magnet assembly in accordance with the fifteenth aspect of the present inventive subject matter;

a second magnet-adhering element; and a device, the device attached to the second magnet-adhering element, the second magnet-adhering element magnetically adhered to the first magnetic element.

In accordance with a seventeenth aspect of the present inventive subject matter, there is provided a body-engaging assembly, comprising:

a body-engaging element; and at least a first magnetic element, the first magnetic element attached to the body-engaging element.

In accordance with an eighteenth aspect of the present inventive subject matter, there is provided a device assembly comprising:

a body-engaging assembly in accordance with the seventeenth aspect of the present inventive subject matter;

at least a first magnet-adhering element; and a device, the device attached to the first magnet-adhering element, the first magnet-adhering element magnetically adhered to the first magnetic element.

In accordance with a nineteenth aspect of the present inventive subject matter, there is provided a magnet assembly, comprising:

a magnetic element; and a non-magnetic, non-magnet-adhering element, the non-magnetic, non-magnet-adhering element attached to the magnetic element, at least a first portion of the non-magnetic, non-magnet-adhering element extending at least 1 centimeter away from the magnetic element.

In some embodiments of magnet assemblies in accordance with the nineteenth aspect of the present inventive subject matter, which can include or not include the feature described in the preceding paragraph, the non-magnetic, non-magnet-adhering element extends around the magnetic element.

In some embodiments of magnet assemblies in accordance with the nineteenth aspect of the present inventive subject matter, which can include none of the features described in the preceding two paragraphs, or any one or more of the features described in the preceding two paragraphs, the non-magnetic, non-magnet-adhering element comprises tape that has a first side and a second side, the first side comprising adhesive.

In accordance with a twentieth aspect of the present inventive subject matter, there is provided a clothing assembly, comprising:

an article of clothing; and at least a first magnetic element, the first magnetic element attached to the article of clothing.

In accordance with a twenty-first aspect of the present inventive subject matter, there is provided a device assembly comprising:

a clothing assembly in accordance with the twentieth aspect of the present inventive subject matter;

a magnet-adhering element; and a device, the device attached to the magnet-adhering element, the magnet-adhering element magnetically adhered to the first magnetic element.

In accordance with a twenty-second aspect of the present inventive subject matter, there is provided a clothing assembly, comprising:

an article of clothing; and at least a first magnet-adhering element, the first magnet-adhering element attached to the article of clothing.

In accordance with a twenty-third aspect of the present inventive subject matter, there is provided a magnetically-positioned magnet assembly, comprising:

a clothing assembly in accordance with the twenty-second aspect of the present inventive subject matter; and at least a first magnetic element, the first magnetic element magnetically adhered to the first magnet-adhering element.

In accordance with a twenty-fourth aspect of the present inventive subject matter, there is provided a device assembly, comprising:

a magnetically-positioned magnet assembly in accordance with the twenty-third aspect of the present inventive subject matter;

a second magnet-adhering element; and a device, the device attached to the second magnet-adhering element, the second magnet-adhering element magnetically adhered to the first magnetic element.

The present inventive subject matter also provides methods of positioning a device relative to a surface such as a mirror, a tiled structure, a piece of glass, or any other relatively smooth surface, the methods including adhering to the surface an attachment element that comprises at least one suction element (e.g. one or more suction cups) or a releasable adhesive material.

Persons of skill in the art are familiar with a variety of suction elements, and any such suitable suction elements can be employed. In some instances, better adhesion can be obtained by moistening the suction element (or suction elements) prior to adhering it (or them) to the surface. Representative examples of suction elements include flexible rubber or plastic elements (e.g., bell-shaped elements) that form an air-tight seal (or substantially air-tight seal) that prevents (or inhibits) the suction elements from falling off of the surface or slipping relative to the surface.

The expression "releasable adhesive materials," as used herein, refers to materials that can be applied to one or both of a first surface (of a first element) and a second surface (of a second element), and that:

when the first and second surfaces are brought into contact, holds the first surface in place relative to the second surface (and thus holds the first element in place relative to the second element);

when the first and second surfaces are in contact, releases the first surface relative to the second surface upon application of a force to remove the first element from the second element (or vice-versa), without severing any material from the first element or from the second element, and without structurally changing the first element or the second element, and then, upon bringing the first and second surfaces back into contact, re-establishes holding the first surface in place relative to the second surface, the releasable adhesive material capable of providing such releasing and re-establishing holding repeatedly.

Persons of skill in the art are also familiar with a variety of releasable adhesive materials, and any of such releasable adhesive materials can be employed.

In some aspects described below, an attachment element (as described above) is adhered to a surface, and a first magnetic element is attached to the attachment element (before, after or during adhering the attachment element to the surface), to provide a positioned magnetic element that can be used to position a device (e.g., a device that is attached to a magnet-adhering element).

In some aspects described below, an attachment element is adhered to a surface, and a first magnet-adhering element is attached to the attachment element (before, after or during adhering the attachment element to the surface), to provide a positioned magnet-adhering element that can be used to position a device (e.g., a device that is attached to a second magnet-adhering element, with one or more magnetic elements between the first magnet-adhering element and the second magnet-adhering element).

In accordance with a twenty-fifth aspect of the present inventive subject matter, there is provided a method of positioning a device, comprising:

adhering at least a first attachment element of an attachment assembly to a first surface, and magnetically adhering a device assembly to the attachment assembly, the attachment assembly comprising at least the first attachment element and at least a first interface element, the first interface element selected from the group consisting of [1] at least one magnetic element and [2] at least one magnet-adhering element, the first interface element attached to the first attachment element, the first attachment element selected from the group consisting of [3] at least one suction element and [4] at least one releasable adhesive material, the device assembly comprising at least a first magnet-adhering element and a device, the device attached to the first magnet-adhering element.

In embodiments in accordance with the twenty-fifth aspect of the present inventive subject matter, said adhering at least a first attachment element of an attachment assembly to a first surface can be performed before, after, or simultaneously with said magnetically adhering a device assembly to the attachment assembly.

In some embodiments in accordance with the twenty-fifth aspect of the present inventive subject matter, the first interface element is a first magnetic element.

In some embodiments in accordance with the twenty-fifth aspect of the present inventive subject matter:

the first interface element is a second magnet-adhering element, and the method further comprises magnetically adhering at least one magnetic element to the second magnet-adhering element. In any of such embodiments, the adhering at least a first attachment element of an attachment assembly to a first surface, the magnetically adhering a device assembly to the attachment assembly, and the magnetically adhering at least one magnetic element to the second magnet-adhering element can be conducted in any order, and/or any two or all three can be conducted simultaneously.

In some embodiments in accordance with the twenty-fifth aspect of the present inventive subject matter:

the first interface element is a second magnet-adhering element, and the method further comprises magnetically adhering at least one magnetic element to the first magnet-adhering element. In any of such embodiments, the adhering at least a first attachment element of an attachment assembly to a first surface, the magnetically adhering a device assembly to the attachment assembly, and the magnetically adhering at least one magnetic element to the first magnet-adhering element can be conducted in any order, and/or any two or all three can be conducted simultaneously.

In some embodiments in accordance with the twenty-fifth aspect of the present inventive subject matter:

the first interface element is a second magnet-adhering element, the attachment assembly further comprises at least a first magnetic element, the method further comprises magnetically adhering at least a second magnetic element to the first magnet-adhering element. In any of such embodiments, the adhering at least a first attachment element of an attachment assembly to a first surface, the magnetically adhering a device assembly to the attachment assembly, and the magnetically adhering at least a second magnetic element to the first magnet-adhering element can be conducted in any order, and/or any two or all three can be conducted simultaneously.

In some embodiments in accordance with the twenty-fifth aspect of the present inventive subject matter, the method further comprises magnetically adhering at least a first magnetic element to the first magnet-adhering element. In any of such embodiments, the adhering at least a first attachment element of an attachment assembly to a first surface, the magnetically adhering a device assembly to the attachment assembly, and the magnetically adhering at least a first magnetic element to the first magnet-adhering element can be conducted in any order, and/or any two or all three can be conducted simultaneously.

In some embodiments in accordance with the twenty-fifth aspect of the present inventive subject matter:

the first interface element is a first magnetic element, and the method further comprises magnetically adhering at least a second magnetic element to the first magnet-adhering element. In any of such embodiments, the adhering at least a first attachment element of an attachment assembly to a first surface, the magnetically adhering a device assembly to the attachment assembly, and the magnetically adhering at least a second magnetic element to the first magnet-adhering element can be conducted in any order, and/or any two or all three can be conducted simultaneously.

The present inventive subject matter also provides positioned devices, in which the positioning of a device is achieved through the use of an attachment element as described above.

In accordance with a twenty-sixth aspect of the present inventive subject matter, there is provided a positioned device, comprising:

an attachment assembly, and a device assembly, the attachment assembly comprising at least a first attachment element and at least a first interface element, the first interface element selected from the group consisting of [1] at least one magnetic element and [2] at least one magnet-adhering element, the first interface element attached to the first attachment element, the first attachment element selected from the group consisting of [3] at least one suction element and [4] at least one releasable adhesive material, the device assembly magnetically adhered to the attachment assembly, the device assembly comprising at least a first magnet-adhering element and a device, the device attached to the first magnet-adhering element.

In some embodiments in accordance with the twenty-sixth aspect of the present inventive subject matter, the first interface element is a first magnetic element.

In some embodiments in accordance with the twenty-sixth aspect of the present inventive subject matter:

the first interface element is a second magnet-adhering element, and the attachment assembly further comprises at least one magnetic element magnetically adhered to the second magnet-adhering element.

In some embodiments in accordance with the twenty-sixth aspect of the present inventive subject matter:

the first interface element is a second magnet-adhering element, and the device assembly further comprises at least one magnetic element magnetically adhered to the first magnet-adhering element.

In some embodiments in accordance with the twenty-sixth aspect of the present inventive subject matter:

the first interface element is a second magnet-adhering element, the attachment assembly further comprises at least a first magnetic element magnetically adhered to the second magnet-adhering element, the device assembly further comprises at least a second magnetic element magnetically adhered to the first magnet-adhering element.

In some embodiments in accordance with the twenty-sixth aspect of the present inventive subject matter, the device assembly further comprises at least a first magnetic element magnetically adhered to the first magnet-adhering element.

In some embodiments in accordance with the twenty-sixth aspect of the present inventive subject matter:

the first interface element is a first magnetic element, and the device assembly further comprises at least a second magnetic element magnetically adhered to the first magnet-adhering element.

The present inventive subject matter also provides magnet assemblies, magnet-adhering element assemblies, and kits that each comprise an attachment element and that can be used as described above in the discussions of methods involving the use of attachment elements.

In accordance with a twenty-seventh aspect of the present inventive subject matter, there is provided an attachment assembly comprising:

at least a first attachment element, and at least a first interface element, the first interface element selected from the group consisting of [1] at least one magnetic element and [2] at least one magnet-adhering element, the first interface element attached to the first attachment element, the first attachment element selected from the group consisting of [3] at least one suction element and [4] at least one releasable adhesive material.

In some embodiments in accordance with the twenty-seventh aspect of the present inventive subject matter, the first interface element is a first magnetic element.

In some embodiments in accordance with the twenty-seventh aspect of the present inventive subject matter:

the first interface is a second magnet-adhering element, and the attachment assembly further comprises at least one magnetic element magnetically adhered to the second magnet-adhering element.

In accordance with a twenty-eighth aspect of the present inventive subject matter, there is provided a kit comprising:

an attachment assembly; and a case assembly, the attachment assembly comprising:

at least a first attachment element; and at least a first magnetic element attached to the first attachment element, the first attachment element comprising at least one member selected from suction elements and releasable adhesive materials.

the case assembly comprising:

a case; and at least a first magnet-adhering element attached to the case.

In accordance with a twenty-ninth aspect of the present inventive subject matter, there is provided a kit comprising:

an attachment assembly;

a case assembly; and at least a first magnetic element, the attachment assembly comprising:

at least a first attachment element; and at least a first magnet-adhering element attached to the first attachment element, the first attachment element comprising at least one member selected from suction elements and releasable adhesive materials, the case assembly comprising:

a case; and at least a first magnet-adhering element attached to the case.

In accordance with each of the aspects described above that involve an attachment element (i.e., the twenty-fifth through the twenty-ninth aspects), the attachment element can comprise structure that assists in removably holding a magnetic element or a magnet-adhering element in place relative to the attachment element. For example, FIG. 50 depicts an attachment element 500 that comprises a suction cup region 501 and a loop region 509 in which a magnetic element or a magnet-adhering element can be held in place frictionally and by a compression force (e.g., by the loop region being resilient and defining an opening that is smaller than a cross-sectional area of the magnetic element or the magnet-adhering element), and FIG. 51 depicts an attachment assembly 510 that comprises a first attachment element (comprising a suction cup region 511 and a loop region 519) and a first magnetic element (in the form of a first magnet 512) attached to the first attachment element by virtue of being held by friction and by a compression force exerted by the loop region 519.

In accordance with a thirtieth aspect of the present inventive subject matter, there is provided a magnetic element assembly, comprising:

a clip assembly that is configured to be supported by an opening-defining portion of a pocket; and at least a first magnetic element attached to the clip assembly.

The expression "opening-defining portion of a pocket" refers to at least a portion of material that extends around an opening through which an interior of a pocket can be accessed (or, in the case of a pocket that has multiple openings through which the interior of the pocket can be accessed, at least a portion of material that extends around at least one of such openings). For example, in the case of a typical pants pocket (or a typical shirt pocket), the opening-defining portion of such pocket includes to uppermost portion of the material sewn onto the pants (or the shirt) to form a pocket.

In some embodiments in accordance with the thirtieth aspect of the present inventive subject matter, the clip assembly holds the magnetic element(s) near the top of the pocket (or at least away from the bottom of the pocket), and the wearer of the clothing that comprises the pocket can easily reach into the pocket without removing the clip assembly or the magnetic element(s) (and/or without altering the location of the clip assembly and the magnetic element(s)). In some embodiments in accordance with the thirty-ninth aspect of the present inventive subject matter, the clip assembly comprises at least a first region configured to clamp at least a portion of the opening-defining portion of a pocket to hold the clip assembly in place relative to the pocket (or to assist in holding the clip assembly in place relative to the pocket).

The inventive subject matter may be more fully understood with reference to the accompanying drawings and the following detailed description of the inventive subject matter.

BRIEF DESCRIPTION OF THE DRAWING FIGURES

FIG. 1 is a schematic cross-sectional illustration showing a magnetic element (in the form of a first magnet 10), a magnet-adhering element (in the form of a metal plate 11) magnetically adhered to the first magnet 10, and a device (in the form of a smart phone 12) attached to the metal plate 11.

FIG. 2 is a schematic cross-sectional illustration showing a magnetic element (in the form of a first magnet 20), a magnet-adhering element (in the form of a metal plate 21) magnetically adhered to the first magnet 20, a device (in the form of a smart phone 22) attached to the metal plate 21 and a second magnetic element (in the form of a second magnet 26).

FIG. 3 is a schematic cross-sectional illustration showing a magnetic element (in the form of a first magnet 30), a first magnet-adhering element (in the form of a first metal plate 31) magnetically adhered to the first magnet 30, a second magnet-adhering element (in the form of a second metal plate 37) also magnetically adhered to the first magnet 30, and a device (in the form of a smart phone 32) attached to the second metal plate 37.

FIG. 4 is a schematic illustration of a kit 48 that comprises:

a first magnetic element (in the form of a first magnet 40);
a second magnetic element (in the form of a second magnet 46);
a device (in the form of a smart phone 42);
a first magnet-adhering element (in the form of a first metal plate 41); and
a second magnet-adhering element (in the form of a second metal plate 47),
the smart phone 42 attached to the first metal plate 41.

FIG. 5 is a schematic cross-sectional illustration showing a positioned device that comprises:

a first magnetic element (in the form of a first magnet 50);
a second magnetic element (in the form of a second magnet 56);
a device (in the form of a smart phone 52); and
a first magnet-adhering element (in the form of a first metal plate 51).

FIG. 6 is a schematic cross-sectional illustration showing a magnet-adhering device assembly that comprises:

a device (in the form of a smart phone 62);
a magnet-adhering element (in the form of a metal plate 61); and
a friction-enhancing member 69.

FIG. 7 is a schematic cross-sectional illustration showing a strap assembly that comprises:

a self-adhering strap 79; and
a first magnet-adhering element (in the form of a first metal plate 71).

FIG. 8 is a schematic illustration of a kit 88 that comprises:

a strap assembly that comprises a self-adhering strap 89 attached to a first magnet-adhering element (in the form of a first metal plate 81); and
a first magnetic element (in the form of a first magnet 80).

FIG. 9 is a schematic cross-sectional illustration showing a magnetically positioned magnet assembly that comprises:

a strap assembly that comprises a self-adhering strap 99 attached to a first magnet-adhering element (in the form of a first metal plate 91); and
a first magnetic element (in the form of a first magnet 90).

FIG. 10 is a schematic cross-sectional illustration showing a device assembly that comprises:

a strap assembly that comprises a self-adhering strap 109 attached to a first magnet-adhering element (in the form of a first metal plate 101);
a first magnetic element (in the form of a first magnet 100);
a device (in the form of a smart phone 102); and
a second magnet-adhering element (in the form of a second metal plate 107).

FIG. 11 is a schematic cross-sectional illustration showing a strap assembly that comprises:

a self-adhering strap 119; and
a first magnetic element (in the form of a first magnet 110).

FIG. 12 is a schematic cross-sectional illustration showing a device assembly that comprises:

a strap assembly that comprises a self-adhering strap 129 attached to a first magnetic element (in the form of a first magnet 120);
a first magnet-adhering element (in the form of a first metal plate 121); and
a device (in the form of a smart phone 122).

FIG. 13 is a schematic cross-sectional illustration showing a body-engaging assembly that comprises:

a body-engaging element 139; and
a first magnet-adhering element (in the form of a first metal plate 131).

FIG. 14 is a schematic cross-sectional illustration showing a kit that comprises:

a body-engaging element 149;
a first magnet-adhering element (in the form of a first metal plate 141); and
a first magnetic element (in the form of a first magnet 140).

FIG. 15 is a schematic cross-sectional illustration showing a magnetically positioned magnet assembly that comprises:

a body-engaging element 159;
a first magnet-adhering element (in the form of a first metal plate 151); and
a first magnetic element (in the form of a first magnet 150).

FIG. 16 is a schematic cross-sectional illustration showing a device assembly that comprises:

a body-engaging element 169;
a first magnet-adhering element (in the form of a first metal plate 161);
a first magnetic element (in the form of a first magnet 160);
a second magnet-adhering element (in the form of a second metal plate 167); and
a device (in the form of a smart phone 162).

FIG. 17 is a schematic cross-sectional illustration showing a body-engaging assembly that comprises:

a body-engaging element 179; and
a first magnetic element (in the form of a first magnet 170).

FIG. 18 is a schematic cross-sectional illustration showing a device assembly that comprises:

a body-engaging element 189;
a first magnetic element (in the form of a first magnet 180);
a first magnet-adhering element (in the form of a first metal plate 181); and
a device (in the form of a smart phone 182).

FIG. 19A is a schematic illustration showing a magnet assembly that comprises:

a magnetic element (in the form of a magnet 190); and
a non-magnetic, non-magnet adhering element 199.

an article of clothing 205; and
at least a first magnetic element (in the form of a first magnet 200).

Figure 21:
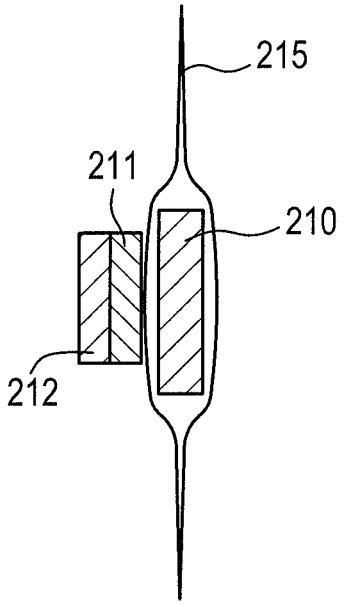

FIG. 21 is a schematic cross-sectional illustration showing a clothing assembly that comprises:

an article of clothing 215;

at least a first magnetic element (in the form of a first magnet 210);

a magnet-adhering element (in the form of a metal plate 211); and a device (in the form of a smart phone 212).

Figure 22:
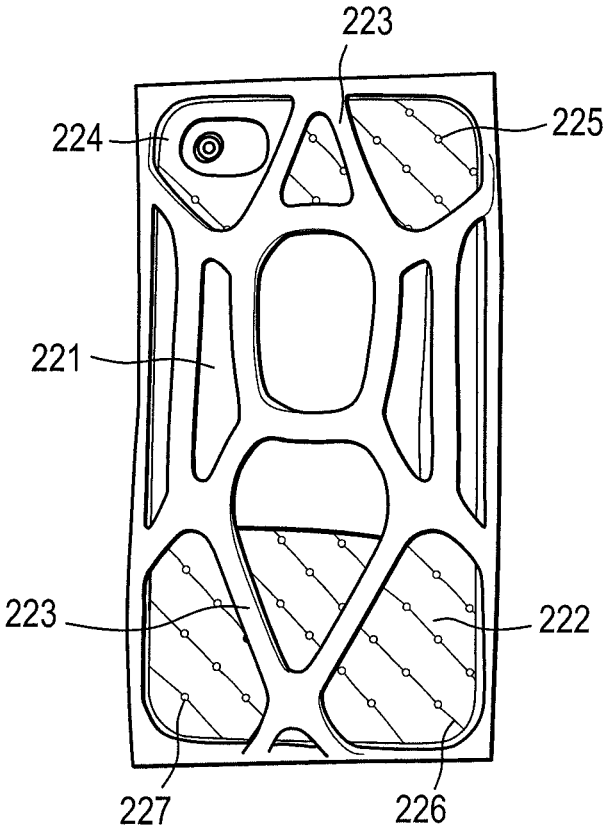

FIG. 22 schematically depicts an example of a case 223 that is attached to a smart phone 222 by surrounding the smart phone 222, even though there are open regions on the case 223.

Figure 23A:
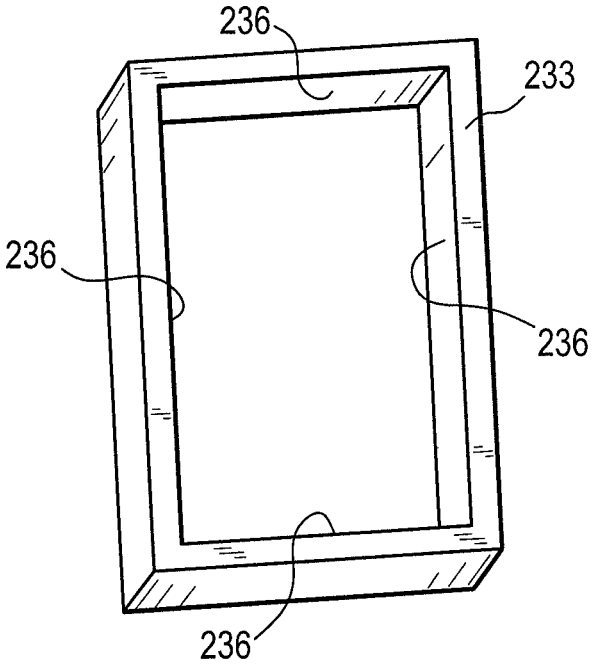
Figure 23B:
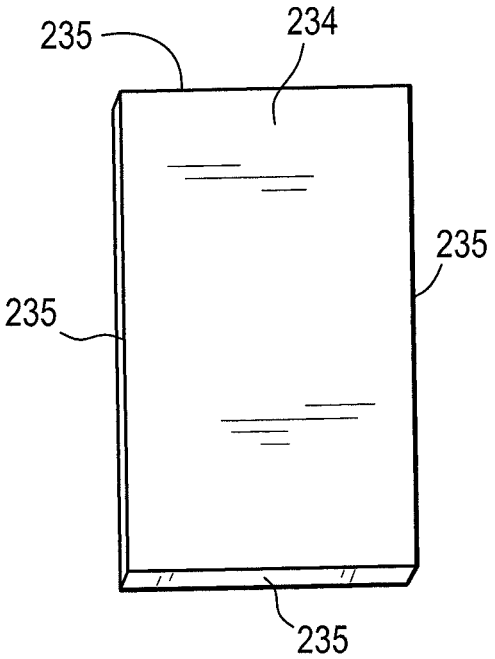

FIGS. 23A and 23B schematically depict an example of a case 233 that is configured to receive and frictionally hold a device (in the form of a smart phone 234) in which the case 233 and the smart phone 234 are of sizes and shapes such that the edges 235 of the smart phone 234 fit snugly within the edges 236 of the case 233.

Figure 24A:
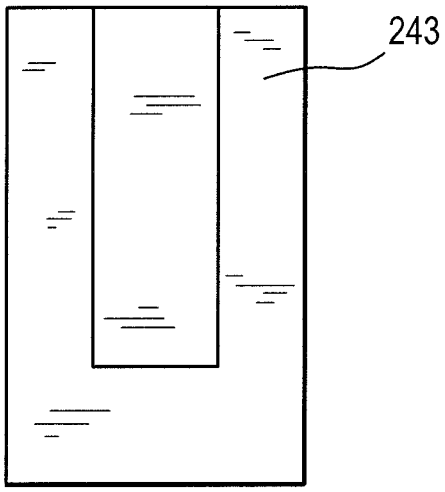
Figure 24B:
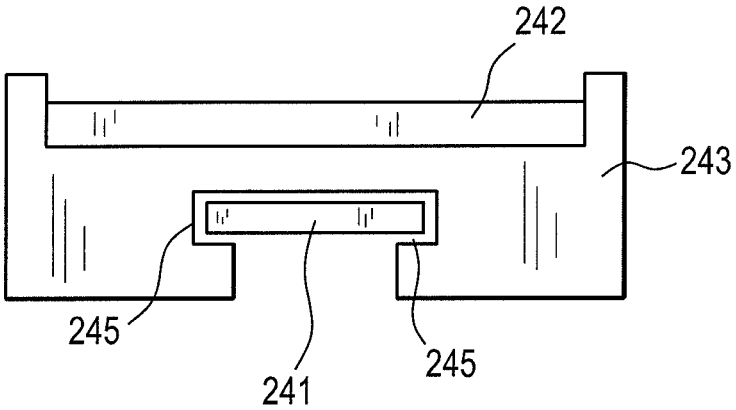

FIGS. 24A and 24B schematically depict an example of a case 243 that comprises slots 245 (on a back side of the case 243); FIG. 24A is a back view of the case 243, and FIG. 24B is a top view of the case 243.

Figure 25:
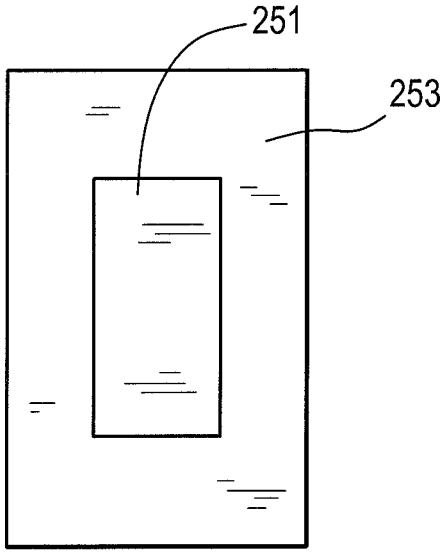

FIG. 25 schematically depicts an example of a case 253 to which a magnet-adhering element (in the form of a metal plate 251) has been glued (on a back side of the case 253).

Figure 26:
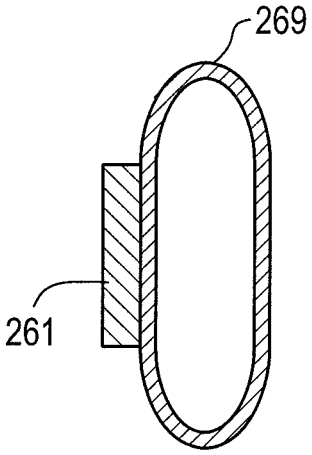

FIG. 26 is a schematic cross-sectional illustration showing a body-engaging assembly that comprises:

a body-engaging element 269; and a first magnet-adhering element (in the form of a first metal plate 261).

Figure 27:
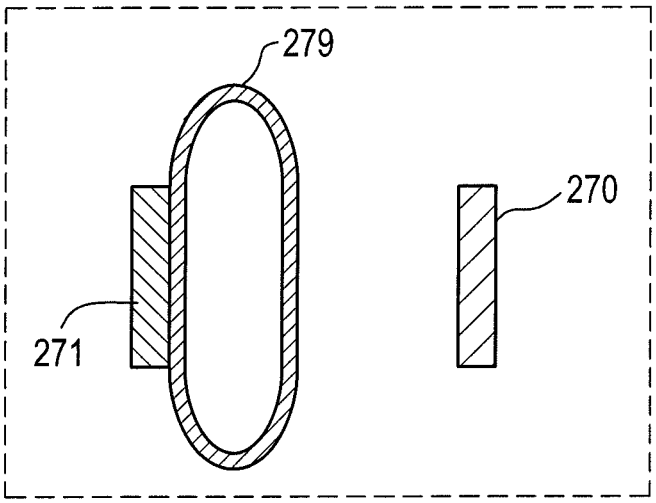

FIG. 27 is a schematic cross-sectional illustration showing a kit that comprises:

a body-engaging element 279;

a first magnet-adhering element (in the form of a first metal plate 271); and a first magnetic element (in the form of a first magnet 270).

Figure 28:
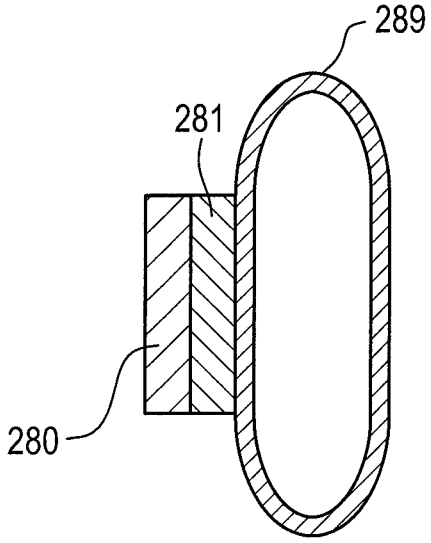

FIG. 28 is a schematic cross-sectional illustration showing a magnetically positioned magnet assembly that comprises:

a body-engaging element 289;

a first magnet-adhering element (in the form of a first metal plate 281); and a first magnetic element (in the form of a first magnet 280).

Figure 29:
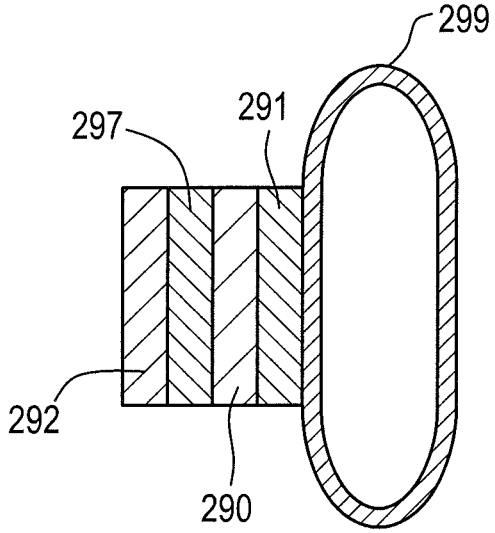

FIG. 29 is a schematic cross-sectional illustration showing a device assembly that comprises:

a body-engaging element 299;

a first magnet-adhering element (in the form of a first metal plate 291);

a first magnetic element (in the form of a first magnet 290);

a second magnet-adhering element (in the form of a second metal plate 297); and a device (in the form of a smart phone 292).

Figure 30:
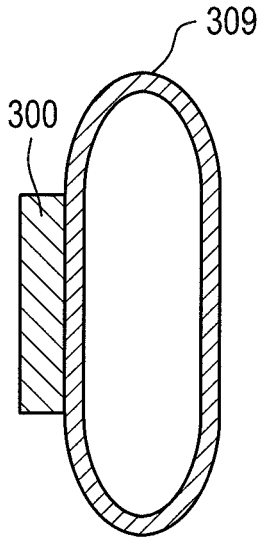

FIG. 30 is a schematic cross-sectional illustration showing a body-engaging assembly that comprises:

a body-engaging element 309; and a first magnetic element (in the form of a first magnet 300).

Figure 31:
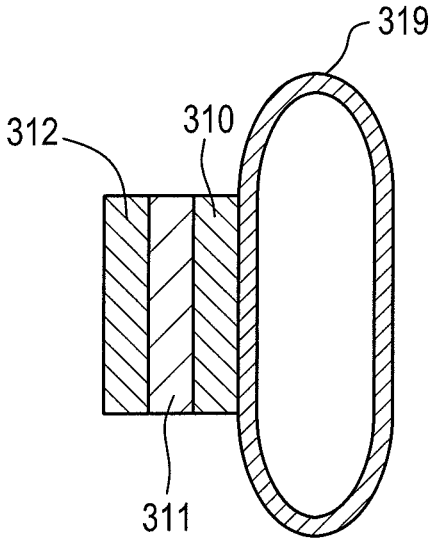

FIG. 31 is a schematic cross-sectional illustration showing a device assembly that comprises:

a body-engaging element 319;

a first magnetic element (in the form of a first magnet 310);

a first magnet-adhering element (in the form of a first metal plate 311); and a device (in the form of a smart phone 312).

Figure 32:
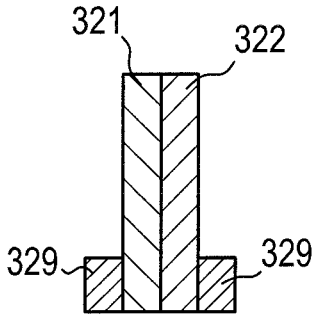

FIG. 32 is a schematic cross-sectional illustration depicting a magnet-adhering device assembly that comprises a strap 329 wrapped around a device (in the form of a smart phone 322) and a magnet-adhering element (in the form of a metal plate 321).

Figure 33:
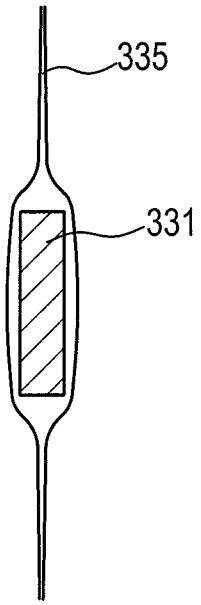

FIG. 33 is a schematic cross-sectional illustration showing a clothing assembly that comprises:

an article of clothing 335; and at least a first magnet-adhering element (in the form of a first metal plate 331).

Figure 34:
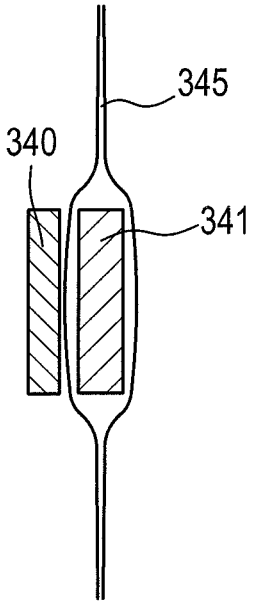

FIG. 34 is a schematic cross-sectional illustration showing a clothing assembly that comprises:

an article of clothing 345;

a first magnet-adhering element (in the form of a first metal plate 341); and at least a first magnetic element (in the form of a first magnet 340).

Figure 35:
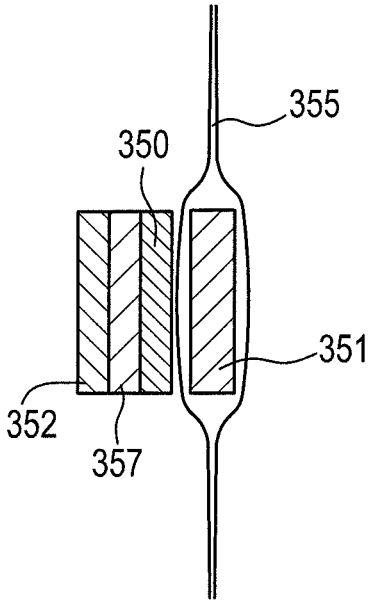

FIG. 35 is a schematic cross-sectional illustration showing a clothing assembly that comprises:

an article of clothing 355;

a first magnet-adhering element (in the form of a first metal plate 357);

at least a first magnetic element (in the form of a first magnet 350);

a second magnet-adhering element (in the form of a metal plate 357); and a device (in the form of a smart phone 352).

Figure 36:
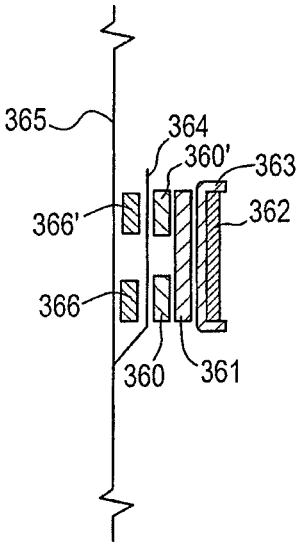

FIG. 36 is a schematic cross-sectional illustration showing a first magnetic element (in the form of a first magnet 360), a second magnetic element (in the form of a second magnet 366), a third magnetic element (in the form of a third magnet 360'), a fourth magnetic element (in the form of a fourth magnet 366').

Figure 37:
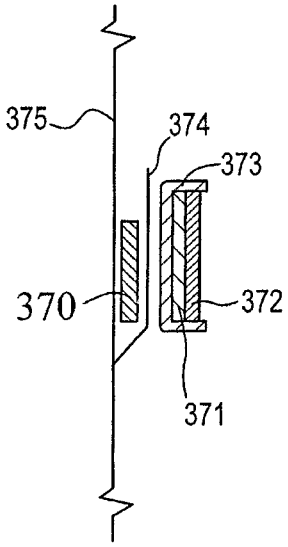

FIG. 37 is a schematic cross-sectional illustration showing a magnetic element (in the form of a first magnet 370), a magnet-adhering element (in the form of a metal plate 371) magnetically adhered to the first magnet 370, and a device (in the form of a smart phone 372) attached to the metal plate 371.

Figure 38:
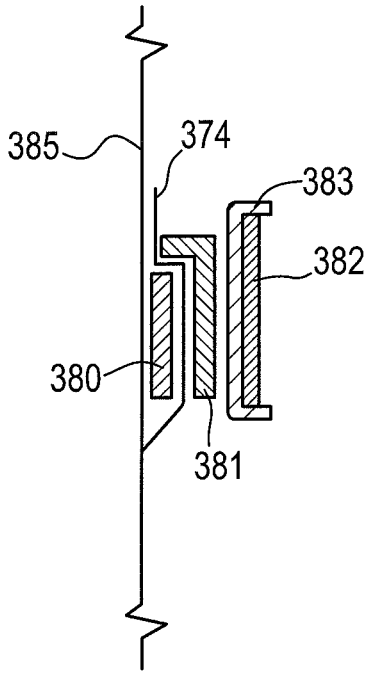

FIG. 38 is a schematic cross-sectional illustration showing a magnetic element (in the form of a first magnet 380), a magnet-adhering element (in the form of a metal plate 381) magnetically adhered to the first magnet 380, and a device (in the form of a smart phone 382) attached to the metal plate 381.

Figure 39:
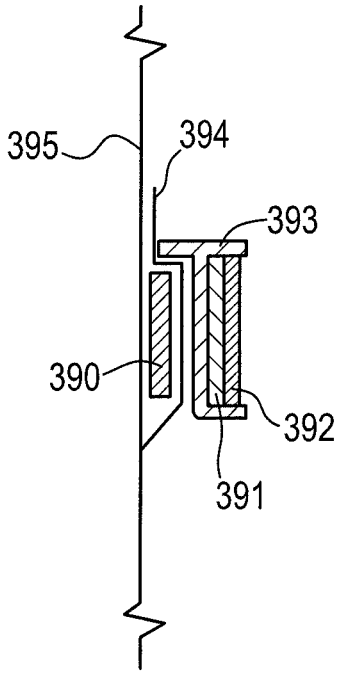

FIG. 39 is a schematic cross-sectional illustration showing a magnetic element (in the form of a first magnet 390), a magnet-adhering element (in the form of a metal plate 391) magnetically adhered to the first magnet 390, a device (in the form of a smart phone 392) attached to the metal plate 391, and a case 393 to which the smart phone 392 and the metal plate 391 are both attached.

Figure 40:
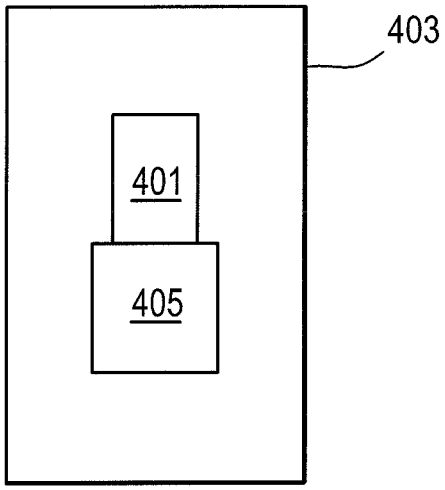

FIG. 40 schematically depicts a case 403, in which a pocket 405 is provided in a back surface of the case 403, and a magnet-adhering element (in the form of a metal plate 401) is frictionally held in the pocket 405.

Figure 41:
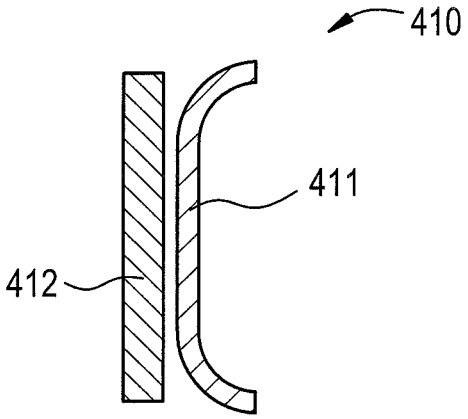

FIG. 41 depicts an attachment assembly 410 that comprises a first attachment element (in the form of a first suction cup 411) and a first magnetic element (in the form of a first magnet 412) attached to the first attachment element.

Figure 42:
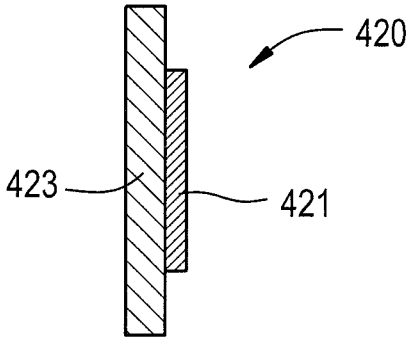

FIG. 42 depicts an attachment assembly 420 that comprises a first attachment element (in the form of a first layer of releasable adhesion material 421) and a first magnet-adhering element (in the form of a first metal plate 423) attached to the first attachment element.

Figure 43:
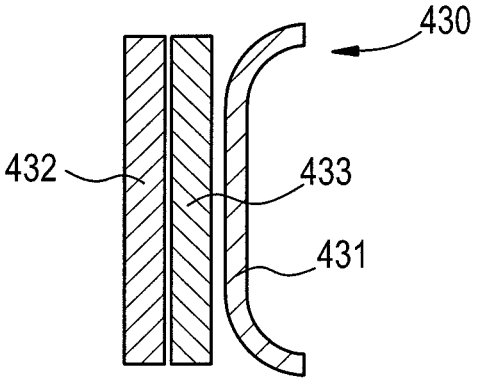

FIG. 43 depicts an attachment assembly 430 that comprises a first attachment element (in the form of a first suction cup 431), a first magnet-adhering element (in the form of a first metal plate 433) attached to the first attachment element, and a first magnetic element (in the form of a first magnet 432) magnetically adhered to the first attachment element.

Figure 44:
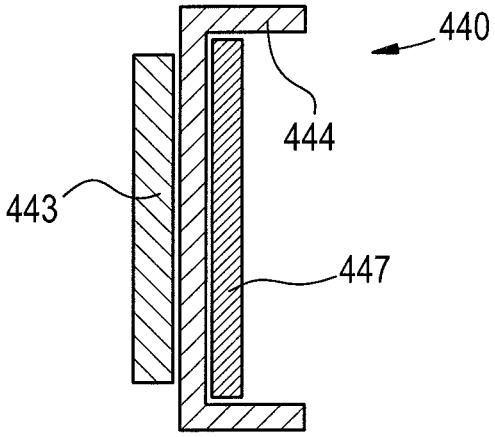

FIG. 44 depicts a device assembly 440 that comprises case 444, a first magnet-adhering element (in the form of a first metal plate 443) and a device (in the form of a smart phone 447).

Figure 45:
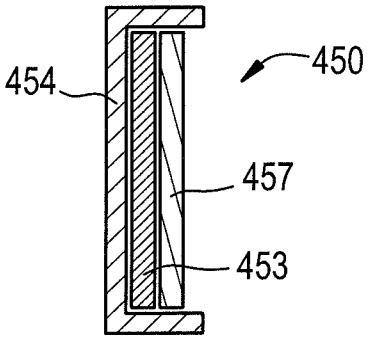

FIG. 45 depicts a device assembly 450 that comprises case 454, a first magnet-adhering element (in the form of a first metal plate 453) and a device (in the form of a smart phone 457).

Figure 46:
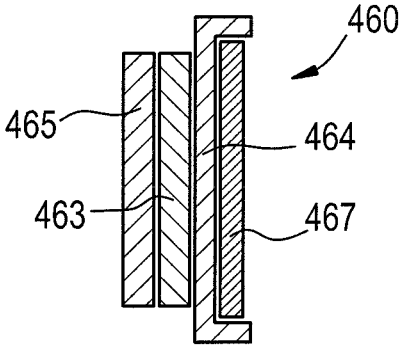

FIG. 46 depicts a device assembly 460 that comprises case 464, a first magnet-adhering element (in the form of a first metal plate 463), a magnet element (in the form of a magnet 465) and a device (in the form of a smart phone 467).

Figure 47:
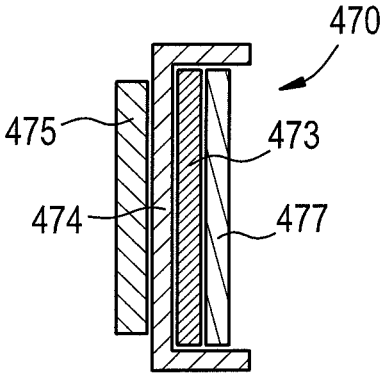

FIG. 47 depicts a device assembly 470 that comprises case 474, a first magnet-adhering element (in the form of a first metal plate 473), a magnet element (in the form of a magnet 475) and a device (in the form of a smart phone 477).

Figure 48:
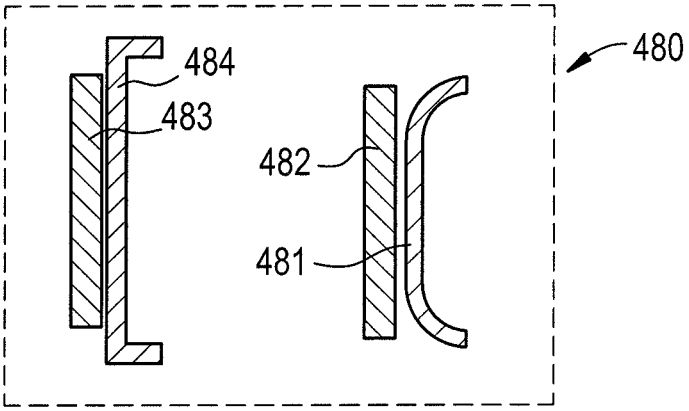

FIG. 48 depicts a kit 480 that comprises an attachment assembly (comprising an attachment element 481 and a first interface element 482) and a case assembly (comprising a case 484 and a magnet-adhering element 483). The first interface element 482 can be at least one magnetic element, a magnet-adhering element or a group of components comprising at least one magnetic element and a magnet-adhering element.

Figure 49:
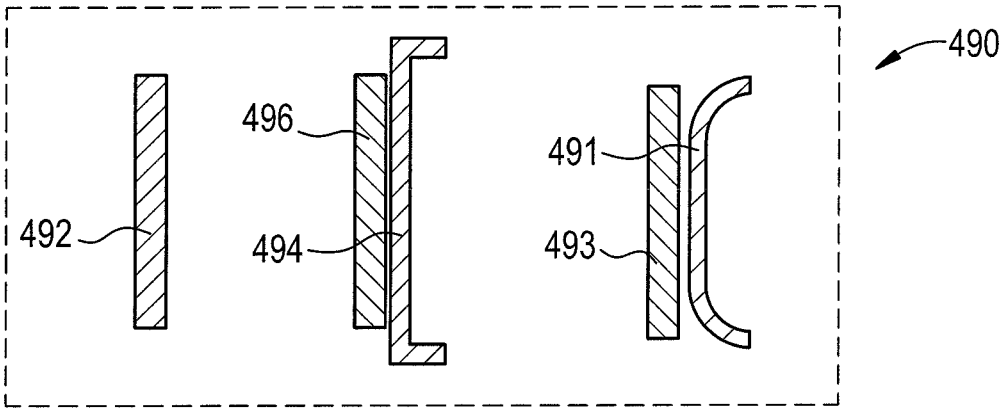

FIG. 49 depicts a kit 490 that comprises an attachment assembly (comprising an attachment element 491 and a first interface element 493), a case assembly (comprising a case 494 and a magnet-adhering element 496) and at least a first magnetic element 492. The first interface element 493 can be a magnetic element, a magnet-adhering element or a group of components comprising a magnetic element and a magnet-adhering element.

Figure 50:
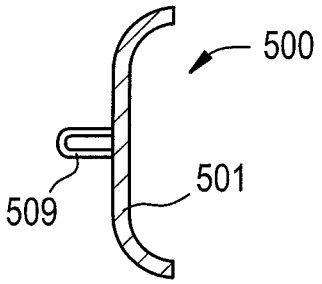

FIG. 50 depicts an attachment element 500 that comprises a suction cup region 501 and a loop region 509 in which a magnetic element or a magnet-adhering element can be held in place frictionally and by a compression force.

Figure 51:
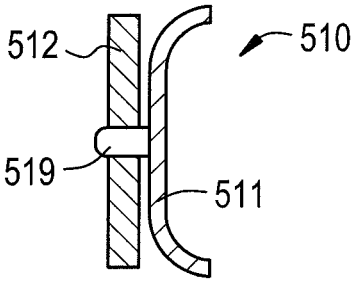

FIG. 51 depicts an attachment assembly 510 that comprises a first attachment element (comprising a suction cup region 511 and a loop region 519) and a first magnetic element (in the form of a first magnet 512) attached to the first attachment element by virtue of being held by friction and by a compression force exerted by the loop region 519.

Figure 52:
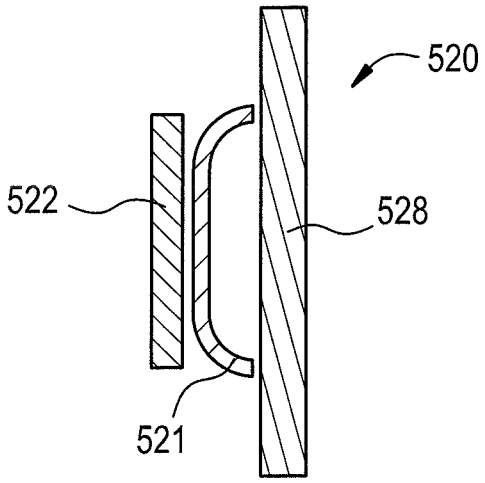

FIG. 52 depicts an attachment assembly removably adhered to a surface (in the form of a mirror 528).

Figure 53:
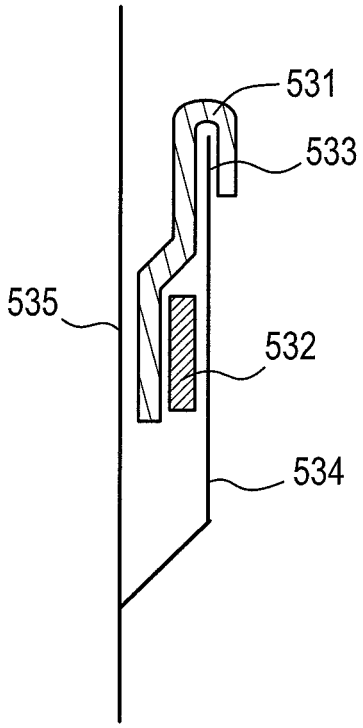

FIG. 53 depicts a representative embodiment of a magnetic element assembly in accordance with the thirtieth aspect of the present inventive subject matter, the magnetic element assembly comprising a clip assembly 531 and a first magnetic element (in the form of a magnet 532).

DETAILED DESCRIPTION OF THE INVENTIVE SUBJECT MATTER

The present inventive subject matter now will be described more fully, including reference to the accompanying drawings, which include schematic representations of embodiments of the inventive subject matter. This inventive subject matter should be construed as described herein, i.e., it is not limited to the specific embodiments described herein.

As used herein, expression term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. A statement that a device or component comprises a "first" of a type of element does not mean that the device or component necessarily has a second (or more) of such components (or that it necessarily does not have a second (or more) of such components). A statement that a device or component comprises an element does not mean that the device or component does not necessarily have a second (or more) of such type of element (or that it necessarily does have a second (or more) of such type of element. It is further noted that the term "comprises" (and similar terms, e.g., the term "comprising"), when used in this specification, specifies the presence of stated features, activities, elements, and/or components, and does not preclude the presence or addition of one or more other features, activities, elements, components, and/or groups thereof.

Although the terms "first", "second", etc. may be used herein to describe various elements, components, regions, sections, etc., these elements, components, regions, sections, etc. are not limited by these numerical terms. These numerical terms are only used to distinguish one element, component, region, section, etc. from another. Thus, an element, component, region or section, etc. discussed below as a "first" element, component, region or section, etc. could be termed a "second" element, component, region or section, etc. without departing from the teachings of the present inventive subject matter.

The expression "in contact with", as used herein (e.g., a first structure is "in contact" with a second structure), means that the first structure that is in contact with a second structure is in direct contact with the second structure or is in indirect contact with the second structure. The expression "in indirect contact with" means that the first structure is not in direct contact with the second structure, but that there are a plurality of structures (including the first and second structures), and each of the plurality of structures is in direct contact with at least one other of the plurality of structures (e.g., the first and second structures are in a stack and are separated by one or more intervening layers). The expression "direct contact", as used in the present specification, means that the first structure which is "in direct contact" with a second structure is touching the second structure and there are no intervening structures between the first and second structures at least at some location.

The expression "adhere" (and analogous expressions, e.g., "adhering", "adhered," etc.) means that a first component (or group of components) is held in place relative to a second component (or group of components).

The expression "self-adhering," as used herein, means that a first region of an article adheres to a second region of the article (and requires a suitable force to remove the first region from the second region). Representative values for force required to remove a first region of a self-adhering article from a second region thereof include at least 2 pounds, at least 3 pounds, at least 4 pounds, at least 5 pounds, at least 6 pounds, at least 7 pounds, at least 8 pounds, at least 9 pounds, at least 10 pounds, etc.

The expression "magnet-adhering," as used herein, encompasses anything that is magnetically attracted by a magnet (i.e., ferromagnetic materials, e.g., iron, nickel, cobalt, anything that contains iron, nickel and/or cobalt, such as steel).

The expression "magnet-adhering element," as used herein, encompasses any structure that is magnetically attracted by a magnet, e.g., a metal plate.

The expression "magnetic element," as used herein, encompasses anything that creates a magnetic field, e.g., a permanent magnet.

The expression "device," as used herein, encompasses anything that is being held in place, e.g., an electronic device, such as a smart phone or a camera.

The expression "assembly," as used herein (e.g., within the expressions "magnet-adhering device assembly," "magnet-adhering assembly," "strap assembly," "magnet assembly," "device assembly," "body-engaging assembly," "clothing assembly," "clip assembly," "attachment assembly" and "magnetic element assembly,") indicates merely that there is a group of components (not necessarily the same group, e.g., different magnet-adhering device assemblies can comprise different groups of components).

The expression "article of clothing," as used herein, encompasses anything that can be worn, e.g., a shirt, pants, a hat, socks, a wristband, etc.

The expression "held in place," as used herein, means that a first device or a component that is "held in place" relative to a second device or component has a desired degree of resistance to translational movement (and optionally also a desired degree of resistance to rotational movement) relative to the second device or component. For example, where it is desired to merely store a device, it might be deemed to be sufficient that translational movement is limited to not more than a small distance (e.g., 1 mm) upon being subjected to a force of five pounds for one second, and that no limit is specified for rotational movement. As another example, where it is desired to hold a device more securely in position as well as rotationally, e.g., when using the device to film video, it might be deemed to be sufficient that translational movement is limited to not more than 0.1 mm upon being subjected to a force of five pounds for one second, and that rotational movement is limited to not more than 1 degree upon being subjected to a force of five pounds for one second.

The expression "magnetically positioned," as used herein, means that a device or a component, or a group of components (e.g., an assembly) that is "magnetically positioned" is held in place at least in part by a magnetic field (e.g., by a magnetic field of a magnetic element, or by a combination of magnetic fields of two or more magnetic elements).

The expression "magnetically adhered," as used herein, means that a device or a component, or a group of components (e.g., an assembly) that is "magnetically adhered" to one or more other device, component or group of components is adhered to the one or more other device, component or group of components at least in part by a magnetic field (e.g., by a magnetic field of a magnetic element, or by a combination of magnetic fields of two or more magnetic elements, and such magnetic element or elements may be in any one or more of such device, component or group of components, or may be a different device or component, or may be in a different group of components). Accordingly, for example, a first component (or assembly) and a second component (or assembly) can be magnetically adhered even though one or more other components is/are between the first component (or assembly) and the second component (or assembly); a first component (or assembly) and a second component (or assembly) can be magnetically adhered by one or more magnetic elements positioned between the first component (or assembly) and the second component (or assembly); a first component (or assembly) and a second component (or assembly) can be magnetically adhered by virtue of a magnetic field provided by a magnetic element in the first component (or assembly) and a magnet-adhering element in the second component (or assembly), etc.

The expression "magnetically adhering," as used herein, means causing a device or a component, or a group of components (e.g., an assembly) to become magnetically adhered (as defined above) to one or more other device, component or group of components.

The expression "attached," as used herein, means that a first structure that is "attached" to a second structure can be rigidly attached to the second structure, frictionally attached to the second structure, surrounded (partially or completely) by the second structure, clamped or otherwise held in place relative to the second structure by a third structure (e.g., a clamp that includes regions that are biased toward each other, with at least the first and second structures therebetween, or a strap, e.g., a self-adhering strap or a resilient strap (such as an annular elastic band), that is wrapped around the first and second structures, or around the first structure and a portion of the second structure (e.g., around a clip attached to the second structure or through an aperture or a slot in the second structure), or around the second structure and a portion of the first structure (e.g., around a clip attached to the first structure or through an aperture or a slot in the first structure), or around a portion of the first structure (e.g., around a clip attached to the second structure or through an aperture or a slot in the second structure) and a portion of the second structure (e.g., around a clip attached to the second structure or through an aperture or a slot in the second structure), or otherwise prevented from being separated from the second structure, e.g., by being glued, stitched, bolted, screwed, riveted, etc., to the second structure (for example, a smart phone that comprises a metal plate, e.g., an Android as of 2017, can be referred to as a "device that is attached to a magnet-adhering element"). Where a first structure and a second structure are held together with a third structure (e.g., a strap), and the second structure is a device (e.g., a smart phone or a camera), preferably, the third structure does not cover any portion of the device that is desired to be seen, e.g., a strap can extend around portions of a smart phone between which the screen resides.

FIG. 32 depicts a magnet-adhering device assembly that comprises a strap 329 wrapped around a device (in the form of a smart phone 322) and a magnet-adhering element (in the form of a metal plate 321).

The expression "adherable," as used herein, means that a first region and a second region of a self-adhering strap are "adherable" if, upon bringing the first region into contact with the second region, the first and second regions become held in place relative to each other; a first region and a second region of a self-adhering strap are "removably adherable" if, upon being brought into contact so that they become held in place relative to each other, the first region and the second region can be separated by applying force to one or both of the first region and the second region to disengage the first region from the second region (and/or to disengage the second region from the first region) without severing any material, and without structurally changing any component in the device.

The expression "friction-enhancing," as used herein, encompasses anything that has a surface that has a frictional coefficient that is greater than a frictional coefficient of a surface to which it is attached, or anything that increases the frictional coefficient of a surface.

The expression "extends around," as used herein, means that a component or device that "extends around" a second component or device comprises regions that extend around the second component or device 360 degrees relative to at least one axis.

The expression "the first surface defines a plane" means [1] that the first surface is substantially flat and at least three points on the first surface are in the plane, and/or [2] that at least 90% of the points in the first surface are located on the plane or between second and third planes that are parallel to the plane and the second plane is on a first side of the plane and is spaced from the plane by a distance of not more than 5% of the largest dimension of the surface, and the third plane is on a second side of the plane and is spaced from the plane by a distance of not more than 5% of the largest dimension of the surface.

The expression "substantially flat" means that at least 90% of the points in the surface which is characterized as being substantially flat are located on one of or between a pair of planes which are parallel and which are spaced from each other by a distance of not more than 5% of the largest dimension of the surface.

The expression "magnetic pole" refers to either of the two points or regions of an artificial or natural magnet to and from which lines of magnetic force are directed (and where the magnetic field is strongest), e.g., in the case of a disc-shaped magnet (button magnet), the opposite surfaces; in the case of a bar magnet or a horseshoe magnet, the opposite ends.

The expression "body-engaging element," as used herein, encompasses any article that can be engaged to (and optionally disengaged from) a body (e.g., a human body, or a body of any animal or living thing), e.g., a bracelet, an anklet, a belt, a necklace, etc.

The expression "annular," as used herein, means a structure that extends around an unfilled region, and which can otherwise be of any general shape, and any cross-sections can be of any shape. For example, "annular" encompasses ring-like shapes which can be defined by rotating a circle about an axis in the same plane as, but spaced from, the circle (one example being where the shape is a rectangle with rounded edges, and a center of the rectangle is a constant distance from a single point on the axis throughout the entire rotation, and where at each stage during the rotation, the rectangle lies in a plane in which the axis also lies; such a shape would be a "circular annular" shape with a uniform substantially rectangular cross-section). "Annular" likewise encompasses shapes which can be defined by rotating a square (or any other two-dimensional shape) about an axis in the same plane as, but spaced from, the square. "Annular" likewise encompasses shapes that can be defined by moving any shape from a first position and orientation, through space along any path without ever moving to a position where part of the shape occupies a space previously occupied by any part of the shape, and eventually returning to the first position and orientation. "Annular" likewise encompasses shapes that can be defined by moving any shape from a first position and orientation, through space along any path without ever moving to a position where part of the shape occupies a space previously occupied by any part of the shape, and eventually returning to the first position and orientation, and where the shape and size of the shape being moved can be altered at any location, and any number of times, during its movement.

The expression "resilient," as used herein, means a structure that can be of a rest shape, i.e., a shape while no external forces (other than gravity and/or friction) are acting upon it, and can be stretched, bent and/or twisted by applying one or more external forces to it, and that returns to its rest shape, or that at least partially moves back toward its rest shape.

The expression "device assembly" means something that comprises a device (e.g., a smart phone) and a magnet-adhering element (e.g., a metal plate), and can optionally further comprise anything else.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

As discussed above, the present inventive subject matter encompasses a large number of different aspects. Various ones of the different aspects comprise or employ recited components and/or features, and can further comprise or employ components and/or features that are not recited.

A number of the aspects described above recite a magnetic element (or more than one magnetic elements). As noted above, the expression "magnetic element" encompasses anything that creates a magnetic field, e.g., a permanent magnet.

A magnetic element (for use in any of the aspects described herein) can consist essentially of (or consist of) a single magnetic material, can consist essentially of (or consist of) two or more magnetic materials, can comprise one or more magnetic materials, can consist essentially of (or consist of) one or more magnetic materials and one or more non-magnetic materials, can comprise one or more magnetic materials and one or more non-magnetic materials, etc.

A variety of magnetic materials are well known, including permanent magnets (e.g., made of naturally magnetic forms of iron or alloys), such as neodymium iron boron (also known as "neodymium magnets"), samarium cobalt, alnico, ceramic and ferrite magnets (strontium-iron), electromagnets and temporary magnets. Many magnetic elements that comprise iron are coated (e.g., with nickel, or plated with a layer of nickel, a layer of copper and a second layer of nickel, and/or with a rubber material) to protect iron in the magnetic material from corrosion, and/or to enhance the frictional coefficient of the surface or surfaces of the magnetic element.

In any method or device in which one or more magnetic element is described herein, two or more magnetic elements can be used in place of any individual magnetic element described herein. For example, instead of an individual magnetic element described herein (e.g., in a pocket in an article of clothing), any suitable number of magnetic elements can be employed for each individual magnet element described herein (e.g., a first magnet can be in a lower region of the pocket and a second magnet can be in a higher region of the pocket, and optionally, one or more additional magnets can be provided), thereby increasing the stability of a magnet-adhering element that is magnetically adhered to the two (or more) magnets. In methods, devices or arrangements in which two magnetic elements are described herein, any one or more of such described magnetic elements can comprise two or more magnetic elements (for example, as described above, in accordance with a second aspect of the present inventive subject matter, there is provided a method of positioning a device, comprising [1] magnetically adhering at least a first magnetic element to a second magnetic element with a first region of an article of clothing between the first magnetic element and the second magnetic element; and [2] magnetically adhering to the first magnetic element at least a first magnet-adhering element to which a device is attached—in such method, there can be three, four or more individual magnetic elements, e.g., there can be a first magnet provided inside the pocket and near the bottom of the pocket, a second magnet provided outside the pocket and near the bottom of the pocket, the second magnet magnetically adhered to the first magnet, a third magnet provided inside the pocket and near the top of the pocket, and a fourth magnet provided outside the pocket and near the top of the pocket, the fourth magnet magnetically adhered to the third magnet, and the first magnet-adhering element (to which the device is attached) can be magnetically adhered to the second magnet and the fourth magnet, thereby increasing the stability of the positioning of the first magnet-adhering element (and the device) as a result of the second magnet and the fourth magnet being at differing locations, and optionally spaced from each other).

Magnetic elements can be obtained in a variety of shapes. Any suitable shape can be employed, and where two or more magnetic elements are employed, the magnetic elements can be of the same general shape or of differing shapes (or some can be of the same general shape). In some embodiments, magnetic elements have at least one substantially flat surface, e.g., a disc-shaped magnetic element having a substantially cylindrical shape with a pair of circular substantially flat surfaces opposite one another and substantially parallel to one another and a curved edge surface extending between the two flat surfaces, the spacing between the two flat surfaces being much smaller than the radius of the circular surfaces (cylindrical is just one example of a standard shape for commercially available magnetic elements; other examples include rectangular blocks, square blocks, cubic blocks, circular rings, spheres, horseshoe shapes, etc.).

Magnetic elements can be selected based (at least in part) on their rated magnetic strengths. The magnetic element (or, where more than one magnetic element is included, each magnetic element) should be chosen so as to have magnetic strength that is sufficient to hold the device or devices sought to be held in place (and/or the "device assembly," i.e., a combination of a device attached to a magnet-adhering element, and optionally other components sought to be held in place).

Evaluating the magnetic strength that is needed (for each magnetic element) requires taking many factors into consideration, including [1] the arrangement of components (as described herein, there are a wide variety of arrangements of components among the different aspects of the present inventive subject matter, and there are a variety of possible arrangements of components even within each individual aspect), [2] the characteristics of those components (e.g., the respective geometries, weights, frictional coefficients of surfaces of each component), [3] the degree to which motion of the device relative to the magnetic element (or elements) is tolerable, and [4] the type(s), direction(s) and magnitude (s) of force(s) acting on any device(s), magnet-adhering element(s) and/or magnetic element(s) involved.

With regard to [1] (i.e., the arrangement of components), a wide variety of aspects relating to arrangement of components affect the magnetic strength required to hold a magnet-adhering element in place. For example, magnetic strength is reduced if a component is between a magnetic element and a magnet-adhering element. One representative situation where a component is between a magnetic element and a magnet-adhering element is where a magnetic element is in a pocket and a magnet-adhering element is outside the pocket, such that at least one layer of clothing is between the magnetic element and the magnet-adhering element, and thus the magnetic strength is reduced. Another representative situation where a component is between a magnetic element and a magnet-adhering element is where a magnet-adhering element and a device are positioned (e.g., friction-fitted) in a case such that a back wall of the case (e.g., where the magnet-adhering element is clamped between the device and the back wall of the case), whereby the back wall of the case (and optionally also at least one layer of clothing) is between the magnetic element and the magnet-adhering element.

In addition, magnetic strength is affected by the number of magnetic elements and (where two or more magnetic elements are used) the positional arrangement and orientation of the magnetic elements relative to each other. For example, where two or more magnetic elements are used, the magnetic strength provided by two or more magnetic elements that are aligned with one another is roughly equal to the sum of the magnetic strengths of each of the magnetic elements ("aligned with one another" meaning that, e.g., each magnetic element has two flat surfaces on opposite sides, the opposite poles of each magnetic element are on those surfaces, and the magnetic elements are stacked with their poles similarly aligned, e.g., each of the magnetic elements is oriented with its north pole on top and its south pole on the bottom).

With regard to [2] (the characteristics of components, e.g., the respective geometries, weights, frictional coefficients of surfaces of each component), magnetic strength is affected by the amount of actual surface area in contact, e.g., where contact between respective surfaces (e.g., a surface of a magnetic element and a surface of a magnet-adhering element) is uneven, magnetic strength is reduced.

The magnitude of required magnetic strength can significantly be affected by frictional coefficients. For example, where an interface between a magnetic element and a magnet-adhering element is non-horizontal (and especially where it is vertical or close to vertical), the greater the frictional coefficients of the respective surfaces, the greater the force required to move the magnet-adhering element relative to the magnetic element.

The magnitude of required magnetic strength is also affected by the weight of the components desired to be held in place by the magnetic element(s), e.g., the magnet-adhering element and the device attached thereto.

With regard to [3] (the degree to which motion of the device relative to the magnetic element(s) is tolerable), for instance, if the device is merely being stored, rotational motion and slight translational motion might be tolerable, whereas if the device is being used as a camera, there might be a desire for the device to not move translationally or rotationally (relative to the magnetic element or elements) to any non-negligible extent.

With regard to [4] (i.e., the type(s) and magnitude(s) of force(s) acting on any device(s), magnet-adhering element (s) and/or magnetic element(s) involved, and the direction(s) of that/those force(s)), pull force ratings for magnetic elements are typically obtained by testing the magnetic elements and recording the tensile force that must be applied to pull a magnetic element away from a magnet-adhering element (or to pull a magnet-adhering element away from a magnetic element that is magnetically adhered, on an opposite surface, to another magnet-adhering element; or to pull one magnetic element away from another magnetic element). Forces tending to pull a magnetic element away from a magnet-adhering element (or elements) typically include at least gravitational force and force generated by changes in movement. For example, such changes in movement can include changes in movement of a person, e.g., in the case of a person wearing an article of clothing that has a shirt pocket, with a second magnetic element in the shirt pocket and a first magnetic element outside the shirt pocket, and with a magnet-adhering element (to which a device is attached) magnetically adhered to the first magnetic element, sudden jumping by the person and stopping of the person (e.g., when the person lands) generates forces that tend to separate the magnet-adhering element from the first magnetic element (and from the second magnetic element). In such situations, where the person is upright (and if the interface between the first magnetic element and the magnet-adhering element is vertical or close to vertical, and the jumping motion is vertical or close to vertical), gravitational force and the force generated by movement of the person will both be primarily shear forces (not tensile forces) acting on the interface between the magnet-adhering element and the first magnetic element (and the second magnetic element). Persons of skill in the art recognize that shear force tolerance is usually less (usually much less) than tensile force tolerance. In other words, given that one can expect (at least some of the time) a large proportion of forces tending to dislodge magnet-adhering elements from magnetic elements to be in shear, the magnetic strength of the magnetic element (or the respective magnetic strengths of the magnetic elements, where more than one magnetic element is involved) should be much larger (e.g., ten times larger) than what would be expected if all forces were tensile.

Other activities similarly generate forces of different magnitudes, e.g., where a person is walking, running, riding a bicycle on pavement, riding a bicycle on mountain trails, snow-skiing on smooth terrain, snow-skiing on moguls, snow-skiing on a jump, water-skiing or wakeboarding on choppy water, water-skiing on calm water, playing sports, etc.

In addition, persons of skill in the art recognize that magnetic strength ratings of magnetic elements are imprecise, and that precise calculations of magnetic strength demands are impossible.

In summary, depending on the expected arrangement of structures and their deployment, the magnetic element (or magnetic elements, where more than one magnetic element is involved) should be chosen to have a magnetic strength (or respective magnetic strengths) that is far in excess of the weight that is expected to be held in place (e.g., the combined weight of the device and the magnet-adhering element to which the device is attached), and it is advisable for the magnetic strength (or magnetic strengths) to be far more than adequate for the specific arrangement in which they are being employed. In view of the relative low cost of magnetic elements (e.g., neodymium magnets) and the significant strengths that can be provided by relatively small magnetic elements, in many instances in accordance with the present inventive subject matter, the magnetic element has a magnetic strength rating that is at least ten times the weight of the component(s) held in place (or designed to be held in place), or, where two or more magnetic elements are provided, the sum of the magnetic strength ratings of the magnetic elements is at least ten times the weight of the component(s) held in place (or designed to be held in place). For instance, if an arrangement that includes only a single magnetic element is designed to hold a smart phone and case (including a magnet-adhering element) having a combined weight of 9 ounces or less, a magnetic element having a rated magnetic strength of 6 pounds might be employed.

Representative values for magnetic force provided by magnetic elements employed in accordance with the present inventive subject matter include 3 pounds, 4 pounds, 5 pounds, 6 pounds, 7 pounds, 8 pounds, 9 pounds, 10 pounds, 11 pounds, 12 pounds, 13 pounds, 14 pounds, 15 pounds, 16 pounds, 17 pounds, 18 pounds, 19 pounds, 20 pounds, 25 pounds, 30 pounds, 35 pounds, or in the range of from 5 pounds to 6 pounds, in the range of from 6 pounds to 7 pounds, in the range of from 7 pounds to 8 pounds, in the range of from 8 pounds to 9 pounds, in the range of from 9 pounds to 10 pounds, in the range of from 10 pounds to 11 pounds, in the range of from 11 pounds to 12 pounds, in the range of from 12 pounds to 13 pounds, in the range of from 13 pounds to 14 pounds, in the range of from 14 pounds to 15 pounds, in the range of from 15 pounds to 16 pounds, in the range of from 16 pounds to 17 pounds, in the range of from 17 pounds to 18 pounds, in the range of from 18 pounds to 19 pounds, in the range of from 19 pounds to 20 pounds, in the range of from 20 pounds to 21 pounds, in the range of from 25 pounds to 30 pounds, in the range of from 30 pounds to 35 pounds, in the range of from 5 pounds to 10 pounds, in the range of from 10 pounds to 15 pounds, in the range of from 15 pounds to 20 pounds, in the range of from 5 pounds to 15 pounds, in the range of from 5 pounds to 20 pounds, in the range of from 5 pounds to 25 pounds, in the range of from 5 pounds to 30 pounds, in the range of from 5 pounds to 35 pounds, in the range of from 10 pounds to 20 pounds, in the range of from 10 pounds to 25 pounds, in the range of from 10 pounds to 30 pounds, in the range of from 10 pounds to 35 pounds, in the range of from 15 pounds to 25 pounds, in the range of from 15 pounds to 30 pounds, in the range of from 15 pounds to 35 pounds, in the range of from 20 pounds to 30 pounds, in the range of from 20 pounds to 35 pounds, or in the range of from 25 pounds to 35 pounds.

A number of the aspects described above recite a magnet-adhering element. As noted above, the expression "magnet-adhering element" encompasses anything that is attracted by a magnetic element, e.g., a metal plate.

Materials that are attracted by magnetic elements include materials that comprise iron, nickel and/or cobalt. Accordingly, a magnet-adhering element (for use in any of the aspects described herein) can consist essentially of (or consist of) a single magnet-adhering material, can consist essentially of (or consist of) two or more magnet-adhering materials, can comprise one or more magnet-adhering materials, can consist essentially of (or consist of) one or more magnet-adhering materials and one or more non-magnet-adhering materials, can comprise one or more magnet-adhering materials and one or more non-magnet-adhering materials, etc.

Magnet-adhering elements can be in any of a variety of shapes. Any suitable shape can be employed. In some embodiments, magnet-adhering elements have at least one substantially flat surface, e.g., a suitable magnet-adhering element can be a substantially flat rectangular shape (for example, a representative magnet-adhering element that can be used with a smart phone is of a six-sided orthorhombic shape, comprising first and second substantially flat rectangular surfaces (top and bottom) that are parallel to each other, approximately of identical size and shape, and four (side) surfaces (each having a small dimension extending between the flat rectangular surfaces and a larger dimension extending from one corner of each rectangular surface to another corner of each rectangular surface), i.e., the overall shape of such representative magnet-adhering element is plate-like (or sheet-like) and rectangular). A magnet-adhering element can be selected to have sufficient mass that (based on the arrangement of elements and the characteristics of the magnetic element(s) employed) it magnetically adheres to the magnetic element(s) with sufficient force to hold the device in place to a desired degree.

In any of the aspects in accordance with the present inventive subject matter, and in any of the embodiments described herein, e.g., any of the embodiments depicted in FIGS. 1-16, 18, 21, 26-29, 31, 32, 35, 36 and 42-49, the magnet-adhering element (or, where there are more than one magnet-adhering elements, one or more of the magnet-adhering elements) can comprise a ledge (or one or more ledges)(or a structure that comprises a ledge)(or a structure that comprises a protuberance that functions in a way that is similar to the function provided by the ledge described below) that is configured to cooperate with (or that can cooperate with) a magnetic element to assist in holding the magnet-adhering element in place relative to the magnetic element. In some instances, the assistance in holding the magnet-adhering element in place relative to the magnetic element can be gravitational (e.g., when the components are in a typical operating arrangement, e.g., a user standing upright, the ledge extends over an edge of the magnetic element so that at least a portion of the ledge is vertically above at least a portion of the magnetic element, and such portion of the ledge is in contact with such portion of the magnetic element); and/or in some cases, the assistance can be frictional and/or in the form of a clamping force; and/or the assistance can be in the nature of any other force tending to hold the magnet-adhering element in place relative to the magnetic element, when the components are in at least one orientation or some orientations. A ledge can be of any shape that provides the attributes described above, i.e., the embodiments described below depict only a representative shape in which a ledge can be.

Figure 1:
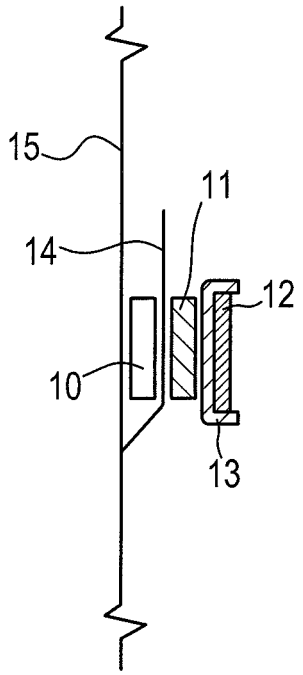

For example, FIG. 38 depicts an embodiment that is similar to the embodiment depicted in FIG. 1, except that in the embodiment depicted in FIG. 38, the magnet-adhering element 381 comprises a ledge (in the orientation depicted in FIG. 38, extending leftward at the uppermost portion of the magnet-adhering element 381) that extends over an edge of the magnetic element 380 so that a portion of the ledge is vertically above a portion of the magnetic element 380, and such portion of the ledge is in contact with the with such portion of the magnetic element 380 (such contact being indirect contact, i.e., the ledge is in contact, indirect contact, with the magnetic element 380, with the shirt pocket 384 between the ledge and the magnetic element 380).

FIG. 38 is a schematic cross-sectional illustration showing a magnetic element (in the form of a first magnet 380), a magnet-adhering element (in the form of a metal plate 381) magnetically adhered to the first magnet 380, and a device (in the form of a smart phone 382) attached to the metal plate 381. The metal plate 381 and the smart phone 382 are attached to one another by virtue of the smart phone 382 being frictionally fitted in a case 383 and the metal plate 381 being glued to the back side of the case 383 (or frictionally fit into grooves on the back side of the case 383). As shown in FIG. 38, the first magnet 380 is in a pocket (namely, a shirt pocket 384) of an article of clothing (in the form of a shirt 385), such that a portion of the article of clothing 385 is between the first magnet 380 and the metal plate 381.

The embodiments shown in FIGS. 1,2, 5, 12, 18, 21, 31, 36, 44, 48 and 49 (with the components arranged as in the orientations depicted) each include a metal plate that could suitably be modified by providing a ledge at (or near) the top of the metal plate, so as to extend over a top of a magnet to which the metal plate is (or can be) magnetically adhered, and such a ledge would gravitationally and frictionally increase the stability of the positioning of the magnet-adhering element relative to the magnetic element, i.e., would assist in holding the magnet-adhering element in place relative to the magnetic element.

The embodiments shown in FIGS. 9, 15, 28, 34, 42, 43, 46 and 49 (with the components arranged as in the orientations depicted) each include a metal plate that could suitably be modified by providing a ledge at (or near) the bottom of the metal plate, so as to extend below a bottom of a magnet to which the metal plate is (or can be) magnetically adhered, and such a ledge would gravitationally and frictionally increase the stability of the positioning of the magnet-adhering element relative to the magnetic element, i.e., would assist in holding the magnet-adhering element in place relative to the magnetic element.

The embodiments shown in FIGS. 3, 4, 10, 16, 2. 359 and 49 (with the components arranged as in the orientations depicted) each include two metal plates in which modifying one of the metal plates by providing a ledge at (or near) its top, and modifying the other of the metal plates by providing a ledge at (or near) its bottom would gravitationally and frictionally increase the stability of the positioning of the magnet-adhering element relative to the magnetic element, i.e., would assist in holding the magnet-adhering element in place relative to the magnetic element.

Figure 7:
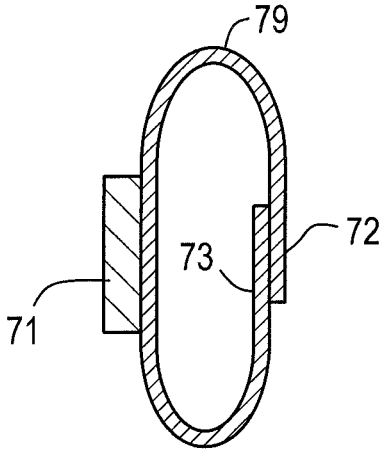

In embodiments that comprise a magnet-adhering element that is configured (or able) to receive a magnetic element, e.g., in the embodiments shown in FIGS. 7, 8, 13, 14, 26, 27 and 33 (for example, FIG. 7 depicts an embodiment in which a magnet-adhering element can be held in place relative to a user, so that an assembly comprising a magnet and a device can be magnetically adhered to the magnet-adhering element), providing the magnet-adhering element with a ledge at (or near) its bottom would be suitable for gravitationally and frictionally increasing the stability of the positioning of the assembly relative to the magnetic element.

Figure 6:
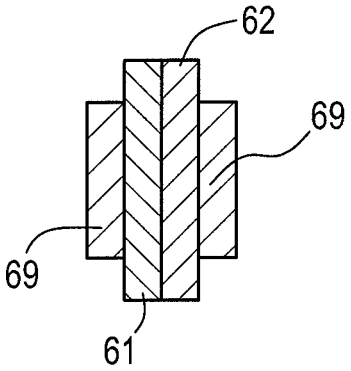

In embodiments that comprise a magnet-adhering element that is configured (or able) to be magnetically adhered to a magnetic element, e.g., in the embodiments shown in FIGS. 6 and 32 (in each of which the magnet-adhering element is attached to a device), providing the magnet-adhering element with a ledge at (or near) its top would be suitable for gravitationally and frictionally increasing the stability of the positioning of the magnet-adhering element relative to the magnetic element.

In an analogous way, in aspects or embodiments that include a case which is attached to a magnet-adhering element, the case can be provided with a ledge (or one or more ledges) that can assist in holding the case relative to a magnetic element to which the magnet-adhering element is magnetically adhered (or to which the magnet-adhering element can be magnetically adhered).

FIG. 39 is a schematic cross-sectional illustration showing a magnetic element (in the form of a first magnet 390), a magnet-adhering element (in the form of a metal plate 391) magnetically adhered to the first magnet 390, and a device (in the form of a smart phone 392) attached to the metal plate 391. The metal plate 391 and the smart phone 392 are attached to one another by virtue of the smart phone 392 being frictionally fitted in a case 393 and the metal plate 391 being between the smart phone 392 and the back side of the case 393. As shown in FIG. 39, the first magnet 390 is in a pocket (namely, a shirt pocket 394) of an article of clothing (in the form of a shirt 395), such that a portion of the article of clothing 395 (as well as a back side of the case 393) is between the first magnet 390 and the metal plate 391. The back side of the case 393 comprises a ledge which assists in holding the case 393 (and therefore also the metal plate 391) in place relative to the first magnet 390.

As noted above, the expression "device" is used herein to refer to anything that is desired to be held in place, e.g., any electronic device (for example, a smart phone, a camera, etc.).

As noted above, the expression "device assembly" is used to refer to an arrangement that comprises a device and a magnet-adhering element (and that optionally further comprises any other component).

Many aspects of the present inventive subject matter involves a "magnet-adhering element to which a device is attached" or a "device attached to a magnet-adhering element." As discussed above, the expression "attached" (and related terms, e.g., "attaching"), as used herein, refers to rigidly attached, frictionally attached, surrounded, clamped by another element, held together with another element, or otherwise prevented from being separated, and therefore the expression "attached" in the context of a device being attached to a magnet-adhering element refers to the device being rigidly attached to a magnet-adhering element, frictionally attached to a magnet-adhering element, surrounded by a magnet-adhering element, clamped to a magnet-adhering element, held together with a magnet-adhering element, or otherwise prevented from being separated from a magnet-adhering element (e.g., the device can be glued to the magnet-adhering element, the device can be bolted to the magnet-adhering element, the device can be screwed to the magnet-adhering element, the device can be riveted to the magnet-adhering element, etc.).

In some embodiments, a magnet-adhering element can be attached to a structure (e.g., a case), and a device can be attached to the same structure, whereby the magnet-adhering element is, in the context of the present inventive subject matter, attached to the device.

Thus, the expression "attached" encompasses any type of attachment.

As noted above, there exist Android devices (as of 2017) that comprise a metal plate, and thus each such Android device is, in the context of the terminology in the present description of the present inventive subject matter, a device assembly that comprises a device that is attached to a magnet-adhering element.

Smart phone users are very familiar with smart phone cases in which smart phones fit snugly, to protect the smart phones and so that the smart phones are held tightly within the case (such cases are typically sized to fit specific smart phones). Such cases typically have a back side and four sides, with an open front (in the context of the present inventive subject matter, such an arrangement is characterized as the case "surrounding" the smart phone, even though one side is open; a case can likewise be characterized as "surrounding" a smart phone even if it has open regions on any or all sides, e.g., the back side can have one or more apertures of any size or shape, and/or any of the sides can only partially cover the corresponding side of the smart phone.

FIG. 22 schematically depicts an example of a case 223 that is attached to a smart phone 222 by surrounding the smart phone 222, even though there are open regions on the case 223. For example, a number of types of "universal phone holders" (e.g., made of rubber) are available (some of such components are stretchable, whereby they can be stretched to extend around each of the four corners 224, 225, 226 and 227 of a device so as to be attached to such device). FIG. 22 also depicts a magnet-adhering element (in the form of a metal plate 221) sandwiched between the case 223 and the smart phone 222, whereby the magnet-adhering element is attached to the smart phone 222.

FIGS. 23A and 23B schematically depict an example of a case 233 that is configured to receive and frictionally hold a device (in the form of a smart phone 234) which is of a size and shape such that the external edges 235 of the smart phone 234 fit snugly within internal edges 236 of the case 233.

A case (if included) can provide a way to hold a magnet-adhering element (or one or more magnet-adhering elements) in place. For example, a case can frictionally hold a device in place (e.g., a case as described above in connection with FIG. 22 or a case as described above in connection with FIGS. 23A and 23B), and a magnet-adhering element can be positioned between the device and a portion of the case (e.g., a back wall of the case), e.g., as depicted in FIG. 22 (in which a metal plate 221 is sandwiched between the case 223 and the smart phone 234), or the embodiment depicted in FIGS. 23A and 23B could be modified to include a metal plate between the back wall of the case 233 and the smart phone 234).

FIGS. 24A and 24B schematically depict an example of a case 243 that comprises slots 245 (on a back side of the case 243) into which a magnet-adhering element (in the form of a metal plate 241) is slid and frictionally held in place. FIG. 24A is a back view of the case 243, and FIG. 24B is a top view of the case 243 (i.e., FIG. 24B shows what would be view by looking down at the case 243 from above the case 243 oriented as depicted in FIG. 24A). A front side of the case 243 is configured to receive and frictionally hold a device (in the form of a smart phone 242), e.g., in the manner that the smart phone 234 in FIGS. 23A and 23B is received and frictionally held in the case 233. Accordingly, the metal plate 241 is attached to the smart phone 242 by virtue of the metal plate 241 being attached to the case 243 (by being held in the slots 245 on the back side of the case 243) and the smart phone 242 being attached to the case 243, e.g., by being frictionally held in the case 243 (e.g., after being pushed in from the front side of the case 243).

FIG. 25 schematically depicts an example of a case 253 to which a magnet-adhering element (in the form of a metal plate 251) has been glued (on a back side of the case 253). A front side of the case 253 is configured to receive and frictionally hold a device (in the form of a smart phone, not shown), e.g., in the manner that the smart phone 234 in FIGS. 23A and 23B is received and frictionally held in the case 233. Accordingly, the metal plate 251 is attached to the smart phone by virtue of the metal plate 251 being attached to the case 253 (by being glued to the back side of the case 253) and the smart phone being frictionally held in the case 253 (after being pushed in from the front side of the case 253).

FIG. 40 depicts a case 403, in which a pocket 405 (made, e.g., of resilient polymeric material) is provided in a back surface of the case 403, and a magnet-adhering element (in the form of a metal plate 401) is frictionally held in the pocket 405.

In any instances where a case is provided, the case can be made of, or can comprise, a material that enhances its friction coefficient, such that, e.g., where a magnetic element is to a first side of the case (or a portion of the case) and a magnet-adhering element is to a second side of the case, and the magnet-adhering element is magnetically adhered to the magnetic element (e.g., in the embodiments depicted in FIGS. 37 and 39).

Figure 2:
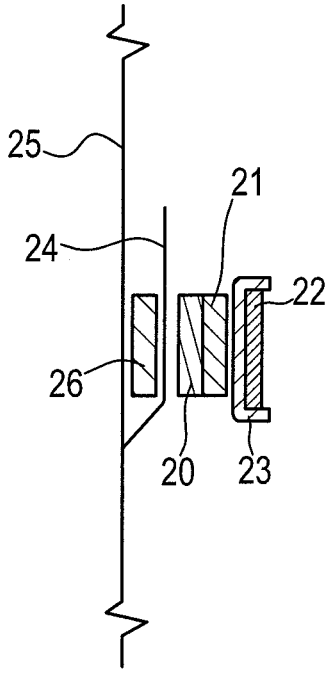

In any of the aspects described herein (and any embodiments disclosed herein), where a case is included, the case can optionally be attached to both a device and a magnet-adhering element in such a way that the magnet-adhering element can be magnetically adhered to a magnetic element without any portion of the case between the magnet-adhering element and the magnetic element (e.g., as in the embodiments depicted in FIGS. 1-3, discussed below), or with a portion of the case between the magnet-adhering element and the magnetic element (e.g., as in the embodiment depicted in FIG. 37), e.g., the embodiment depicted in FIG. 2 (discussed below) could be modified such that a portion of the case 23 is between the metal plate 21 and the first magnet 20).

As discussed above, in accordance with a first aspect of the present inventive subject matter, there is provided a method of positioning a device, comprising:

placing at least a first magnetic element in a pocket in an article of clothing, and magnetically adhering to the first magnetic element at least a first magnet-adhering element to which a device is attached.

FIG. 1 is a schematic cross-sectional illustration showing a magnetic element (in the form of a first magnet 10), a magnet-adhering element (in the form of a metal plate 11) magnetically adhered to the first magnet 10, and a device (in the form of a smart phone 12) attached to the metal plate 11. The metal plate 11 and the smart phone 12 are attached to one another by virtue of the smart phone 12 being frictionally fitted in a case 13 and the metal plate 11 being glued to the back side of the case 13 (or frictionally fit into grooves on the back side of the case 13, or held in a pocket on the back side of the case 13). As shown in FIG. 1, the first magnet 10 is in a pocket (namely, a shirt pocket 14) of an article of clothing (in the form of a shirt 15), such that a portion of the article of clothing 15 is between the first magnet 10 and the metal plate 11.

In accordance with a representative example of an embodiment according to the first aspect of the present inventive subject matter, the first magnet 10 is placed in the pocket 14 of the shirt 15, and then the metal plate 11 is magnetically adhered to the first magnet 10 (therefore magnetically adhering the device assembly, comprising the case 13 with the metal plate 11 and the smart phone 12 attached thereto, to the first magnet 10).

A related embodiment is depicted in FIG. 37. The embodiment depicted in FIG. 37 is the same as the embodiment depicted in FIG. 1, except that the metal plate 371 is attached to the case 373 by being between the smart phone 372 and the back side of the case 373. Accordingly, a portion of the article of clothing 375 and the back side of the case 373 are between the first magnet 370 and the metal plate 371. In this embodiment (as compared to the embodiment depicted in FIG. 1), the first magnet 370 must generally be of greater magnetic strength than the first magnet 10 (all other factors being the same) to provide the same holding strength for the smart phone 372, because the case 373 and the portion of the article of clothing 375 are between the first magnet 370 and the metal plate 371 (whereas in the embodiment depicted in FIG. 1, only the portion of the article of clothing 15 is between the first magnet 10 and the metal plate 11).

In some embodiments in accordance with the present inventive subject matter, including some embodiments according to this aspect (and some embodiments according to other aspects described herein), the device is not held by a top region of a pocket (or a middle region), e.g., in this instance, the first magnet 10 tends to fall to the bottom of the pocket. In some such situations, the lower portion of the pocket (which, unlike the top, is stitched to the another layer of the garment, e.g., a main layer of material makes a shirt, and an outer portion of a shirt pocket is made by stitching a piece of cloth that is roughly the size of the pocket on each side and the bottom, leaving the top open) is less flimsy than the top portion of the pocket, and so the device is held more firmly (e.g., in comparison to where a device is attached to a clip that engages the top of the pocket).

As discussed above, in accordance with a second aspect of the present inventive subject matter, there is provided a method of positioning a device, comprising:

magnetically adhering at least a first magnetic element to a second magnetic element with a first region of an article of clothing between the first magnetic element and the second magnetic element, magnetically adhering to the first magnetic element at least a first magnet-adhering element to which a device is attached.

FIG. 2 is a schematic cross-sectional illustration showing a magnetic element (in the form of a first magnet 20); a magnet-adhering element (in the form of a metal plate 21) magnetically adhered to the first magnet 20; a device (in the form of a smart phone 22) attached to the metal plate 21; and a second magnetic element (in the form of a second magnet 26). The metal plate 21 and the smart phone 22 are attached to one another by virtue of the smart phone 22 being frictionally fitted in a case 23 and the metal plate being attached to the back side of the case 23. The first magnet 20 is magnetically adhered to the second magnet 26. As shown in FIG. 2, the second magnet 26 is in a pocket (namely, a shirt pocket 24) of an article of clothing (in the form of a shirt 25) and the first magnet 20 is outside the pocket, such that a portion of the article of clothing 25 is between the first magnet 20 and the second magnet 26.

In accordance with a representative example of an embodiment according to the second aspect of the present inventive subject matter, the second magnet 26 is placed in the pocket 24 of the shirt 25, then the first magnet 20 is placed outside the pocket 24 and magnetically adhered to the second magnet 26 (such that a portion of the shirt is between the first magnet 20 and the second magnet 26), and then the metal plate 21 is magnetically adhered to the first magnet 20 (therefore magnetically adhering the device assembly, comprising the case 23 with the metal plate 21 and the smart phone 22 attached thereto, to the first magnet 20 and to the second magnet 26).

As discussed above, in accordance with a third aspect of the present inventive subject matter, there is provided a method of positioning a device, comprising:

magnetically adhering at least a first magnetic element to a first magnet-adhering element with a first region of an article of clothing between the first magnetic element and the first magnet-adhering element; and magnetically adhering to the first magnetic element at least a second magnet-adhering element to which a device is attached.

Figure 3:
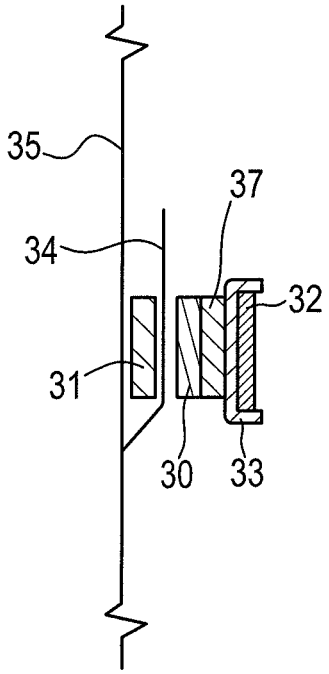

FIG. 3 is a schematic cross-sectional illustration showing a magnetic element (in the form of a first magnet 30), a first magnet-adhering element (in the form of a first metal plate 31) magnetically adhered to the first magnet 30, a second magnet-adhering element (in the form of a second metal plate 37) also magnetically adhered to the first magnet 30, and a device (in the form of a smart phone 32) attached to the second metal plate 37. The second metal plate 37 and the smart phone 32 are attached to one another by virtue of the smart phone 32 being frictionally fitted in a case 33 and the second metal plate 37 being attached to the back side of the case 33. As shown in FIG. 3, the first metal plate 31 is in a pocket (namely, a shirt pocket 34) of an article of clothing (in the form of a shirt 35) and the first magnet 30 is outside the pocket, such that a portion of the article of clothing 35 is between the first magnet 30 and the first metal plate 31.

In accordance with a representative example of an embodiment according to the third aspect of the present inventive subject matter, the first metal plate 31 is placed in the pocket 34 of the shirt 35, then the first magnet 30 is placed outside the pocket 34 and magnetically adhered to the first metal plate 31 (such that a portion of the shirt 35 is between the first magnet 30 and the first metal plate 31), and then the second metal plate 37 is magnetically adhered to the first magnet 30 (therefore magnetically adhering the device assembly, comprising the case 33 with the second metal plate 37 and the smart phone 32 attached thereto, to the first magnet 30).

As discussed above, in accordance with a fourth aspect of the present inventive subject matter, there is provided a kit for providing a device magnetically held in place, the kit comprising:

at least a first magnetic element;
a device; and
at least a first magnet-adhering element,
the device attached to the first magnet-adhering element.

Figure 4:
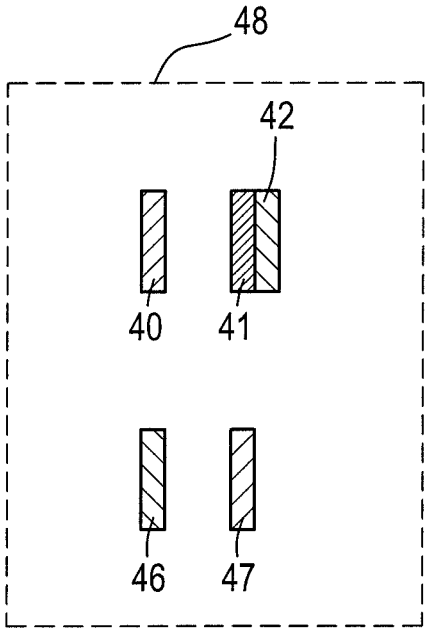

FIG. 4 is a schematic illustration of a kit 48 that comprises:

a first magnetic element (in the form of a first magnet 40);
a second magnetic element (in the form of a second magnet 46);
a device (in the form of a smart phone 42);
a first magnet-adhering element (in the form of a first metal plate 41); and
a second magnet-adhering element (in the form of a second metal plate 47),
the smart phone 42 attached to the first metal plate 41.

A kit can further comprise packaging, e.g., packaging in which the components of the kit are held. For example, a kit (e.g., the kit depicted in FIG. 4) can further comprise packaging that defines a space having a volume that is not more than 10% greater (or not more than 5% greater, or not more than 15% greater, or not more than 20% greater, or not more than 25% greater, or not more than 30% greater, or not more than 40% greater, or not more than 50% greater) than the sum of the respective volumes of the other components in the kit.

As discussed above, in accordance with a fifth aspect of the present inventive subject matter, there is provided a positioned device, comprising:

at least a first magnetic element;
a device; and
at least a first magnet-adhering element,
the device attached to the first magnet-adhering element,
the first magnet-adhering element magnetically adhered to the at least a first magnetic element.

Figure 5:
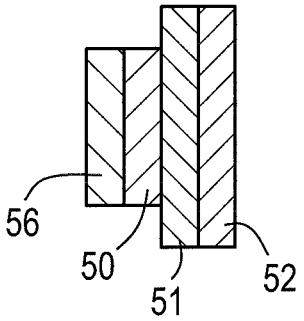

FIG. 5 is a schematic cross-sectional illustration showing a positioned device that comprises:

a first magnetic element (in the form of a first magnet 50);
a second magnetic element (in the form of a second magnet 56);
a device (in the form of a smart phone 52); and
a first magnet-adhering element (in the form of a first metal plate 51).

As shown in FIG. 5, the smart phone 52 is attached to the first metal plate 51, the first metal plate 51 is magnetically adhered to the first magnet 50, and the second magnet 56 is magnetically adhered to the first magnet 50.

As discussed above, in accordance with a sixth aspect of the present inventive subject matter, there is provided a magnet-adhering device assembly, comprising:

a device;
a magnet-adhering element; and
a friction-enhancing member,
the magnet-adhering element attached to the device,
the friction-enhancing member attached to the magnet-adhering element.

In some embodiments of magnet-adhering device assemblies in accordance with the sixth aspect of the present inventive subject matter, the friction-enhancing member extends around the magnet-adhering element and the device.

FIG. 6 is a schematic cross-sectional illustration showing a magnet-adhering device assembly that comprises:

a device (in the form of a smart phone 62);
a magnet-adhering element (in the form of a metal plate 61); and
a friction-enhancing member 69.

As shown in FIG. 6, the metal plate 61 is attached to the smart phone 62, and the friction-enhancing member 69 is attached to the metal plate 61. In addition, in the embodiment depicted in FIG. 6, the friction-enhancing member 69 extends around the metal plate 61 and the smart phone 62.

As noted above, the expression "friction-enhancing," as used herein, encompasses anything that has a surface that has a frictional coefficient that is greater than a frictional coefficient of a surface to which it is attached, or anything that increases the frictional coefficient of a surface. Representative examples of friction-enhancing members include rubber members (e.g., an annular rubber sheath into which a device and a magnet-adhering element can be tightly fit, optionally with surface irregularities), coarse members (e.g., a layer or coating that has surface irregularities), grooved members (e.g., a layer that has horizontal grooves and/or diagonal grooves, and/or diagonal grooves extending in opposite diagonal directions, i.e., extending upward to the right or extending downward to the right, and/or combinations thereof), tape (e.g., tape that has adhesive on one side and surface irregularities on the other side), etc. Friction-enhancing members can be provided to increase the likelihood that a device will be held in place relative to a magnetic element in given situations (e.g., when subjected to particular forces), and/or to reduce the extent to which a device moves relative to a magnetic element in given situations (e.g., when subjected to particular forces).

As discussed above, in accordance with a seventh aspect of the present inventive subject matter, there is provided a strap assembly, comprising:

a self-adhering strap; and
at least a first magnet-adhering element,
the first magnet-adhering element attached to the self-adhering strap.

FIG. 7 is a schematic cross-sectional illustration showing a strap assembly that comprises:

a self-adhering strap 79; and
a first magnet-adhering element (in the form of a first metal plate 71).

As shown in FIG. 7, the first metal plate 71 is attached to the self-adhering strap 79. In the embodiment depicted in FIG. 7, the self-adhering strap 79 comprises a first adherence region 72 and a second adherence region 73, and the first adherence region 72 is removably adherable to the second adherence region 73.

The area that can be circumscribed by the self-adhering strap 79, e.g., which is defined by [1] the distance, if any, along the strap 79, between the first adherence region 72 and the second adherence region 73, [2] the length, along the strap 79, that the first adherence region 72 extends, [3] the length, along the strap 79, that the second adherence region 73 extends, and [4] the length that the first adherence region is designed to overlap the second adherence region 73, or that the second adherence region 73 needs to overlap the first adherence region 72 to provide sufficient adherence) can be selected based on the region of a person's body for which it is desired that the self-adhering strap is to be attached; e.g., for attaching to an adult wrist, the spacing might be in the range of from about six inches to about ten inches, plus the length of overlap (e.g., two to three inches); for attaching to an adult ankle, the spacing might be in the range of from about eight inches to about twelve inches, plus the length of overlap (e.g., two to three inches); for attaching to an adult arm (biceps), the spacing might be in the range of from about twelve inches to about eighteen inches, plus the length of overlap (e.g., two inches to four inches); for attaching to an adult head, the spacing might be in the range of from about twenty inches to about twenty-eight inches, plus the length of overlap (e.g., two inches to four inches); for attaching to an adult waist, the spacing might be in the range of from about twenty-four inches to about forty-five inches, plus the length of overlap (e.g., two inches to four inches). Adherence regions can be discrete regions (e.g., a strap can have first and second regions that have characteristics that adhere to one another, and a third region, between the first and second regions, that does not have characteristics that provide adherence) or sub-regions of a continuous (or substantially continuous) region that has characteristics that provide for adherence.

Any suitable type of adherence (or combinations thereof) can be designed for the adherence regions. For example, representative types of adherence can include one or more snaps (i.e., corresponding protruding structures and receiving structures), one or more button/buttonhole combinations, fasteners (such as fastener marketed under the trademark VELCRO®, adhesive, one or more buckle/hole combinations, etc.

Alternatively, adherence regions can be designed to overlap and be clamped together.

As discussed above, in accordance with an eighth aspect of the present inventive subject matter, there is provided a kit comprising a strap assembly in accordance with the seventh aspect of the present inventive subject matter, and at least a first magnetic element.

Figure 8:
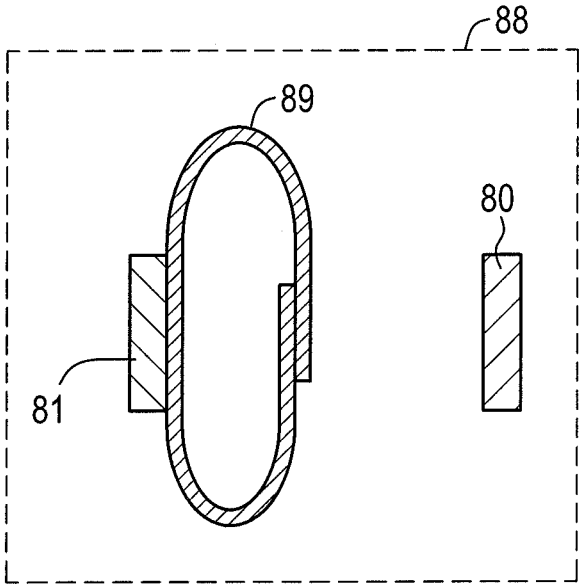

FIG. 8 is a schematic illustration of a kit 88 that comprises:

- a strap assembly that comprises a self-adhering strap 89 attached to a first magnet-adhering element (in the form of a first metal plate 81); and
- a first magnetic element (in the form of a first magnet 80).

The discussion above of strap assemblies (including the disclosure in the discussion relating to the embodiment depicted in FIG. 7) is applicable to the self-adhering strap 89.

The kit can further comprise packaging, e.g., packaging in which the components of the kit are held. For example, the kit depicted in FIG. 8 can further comprise packaging that defines a space having a volume that is not more than 10% greater (or not more than 5% greater, or not more than 15% greater, or not more than 20% greater, or not more than 25% greater, or not more than 30% greater, or not more than 40% greater, or not more than 50% greater) than the sum of the respective volumes of the other components in the kit.

As discussed above, in accordance with a ninth aspect of the present inventive subject matter, there is provided a magnetically positioned magnet assembly, comprising a strap assembly in accordance with the seventh aspect of the present inventive subject matter, and at least a first magnetic element which is magnetically adhered to the first magnet-adhering element.

Figure 9:
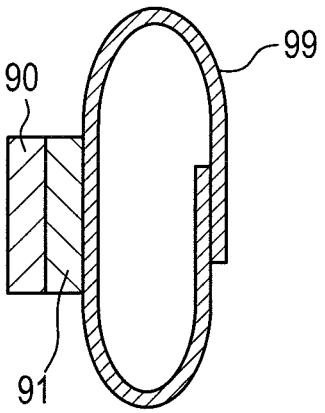

FIG. 9 is a schematic cross-sectional illustration showing a magnetically positioned magnet assembly that comprises:

- a strap assembly that comprises a self-adhering strap 99 attached to a first magnet-adhering element (in the form of a first metal plate 91); and
- a first magnetic element (in the form of a first magnet 90).

As shown in FIG. 9, the first metal plate 91 is magnetically adhered to the first magnet 90.

The discussion above of strap assemblies (including the disclosure in the discussion relating to the embodiment depicted in FIG. 7) is applicable to the self-adhering strap 99.

As discussed above, in accordance with a tenth aspect of the present inventive subject matter, there is provided a device assembly, comprising:

- a magnetically positioned magnet assembly in accordance with the ninth aspect of the present inventive subject matter;
- a second magnet-adhering element; and
- a device,
- the device attached to the second magnet-adhering element,
- the second magnet-adhering element magnetically adhered to the first magnetic element.

Figure 10:
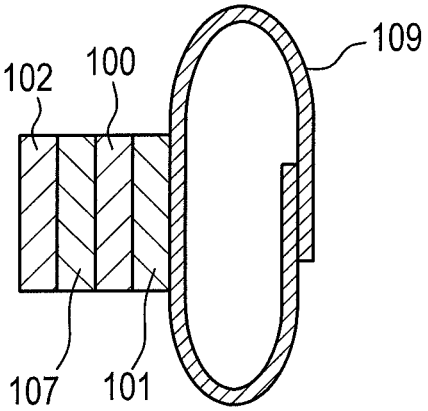

FIG. 10 is a schematic cross-sectional illustration showing a device assembly that comprises:

- a strap assembly that comprises a self-adhering strap 109 attached to a first magnet-adhering element (in the form of a first metal plate 101);
- a first magnetic element (in the form of a first magnet 100);
- a device (in the form of a smart phone 102); and
- a second magnet-adhering element (in the form of a second metal plate 107).

As shown in FIG. 10, the first metal plate 101 is magnetically adhered to the first magnet 100, the smart phone 102 is attached to the second metal plate 107, and the second metal plate 107 is magnetically adhered to the first magnet 100.

The discussion above of strap assemblies (including the disclosure in the discussion relating to the embodiment depicted in FIG. 7) is applicable to the self-adhering strap 109.

As discussed above, in accordance with an eleventh aspect of the present inventive subject matter, there is provided a strap assembly, comprising:

- a self-adhering strap; and
- at least a first magnetic element,
- the first magnetic element attached to the self-adhering strap.

Figure 11:
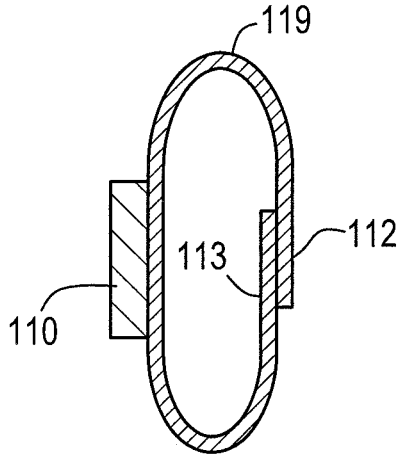

FIG. 11 is a schematic cross-sectional illustration showing a strap assembly that comprises:

- a self-adhering strap 119; and
- a first magnetic element (in the form of a first magnet 110).

As shown in FIG. 11, the first magnet 110 is attached to the self-adhering strap 119. In the embodiment depicted in FIG. 11, the self-adhering strap 119 comprises a first adherence region 112 and a second adherence region 113, and the first adherence region 112 is removably adherable to the second adherence region 113.

The discussion above of strap assemblies (including the disclosure in the discussion relating to the embodiment depicted in FIG. 7) is applicable to the self-adhering strap 119.

As discussed above, in accordance with a twelfth aspect of the present inventive subject matter, there is provided a device assembly, comprising:

a strap assembly in accordance with the eleventh aspect of the present inventive subject matter;

at least a first magnet-adhering element; and a device, the device attached to the first magnet-adhering element, the first magnet-adhering element magnetically adhered to the first magnetic element.

Figure 12:
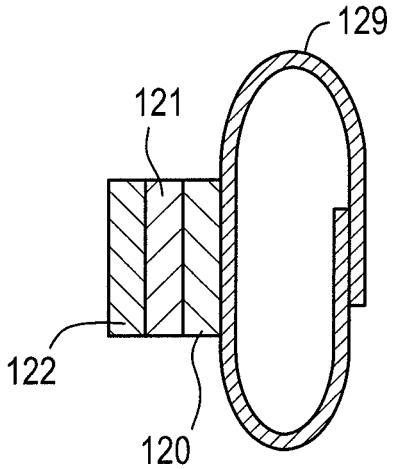

FIG. 12 is a schematic cross-sectional illustration showing a device assembly that comprises:

a strap assembly that comprises a self-adhering strap 129 attached to a first magnetic element (in the form of a first magnet 120);

a first magnet-adhering element (in the form of a first metal plate 121); and a device (in the form of a smart phone 122).

As shown in FIG. 12, the smart phone 122 is attached to the first metal plate 121, and the first metal plate 121 is magnetically adhered to the first magnet 120.

The discussion above of strap assemblies (including the disclosure in the discussion relating to the embodiment depicted in FIG. 7) is applicable to the self-adhering strap 129.

As discussed above, in accordance with a thirteenth aspect of the present inventive subject matter, there is provided a body-engaging assembly, comprising:

a body-engaging element; and at least a first magnet-adhering element, the first magnet-adhering element attached to the body-engaging element.

Figure 13:
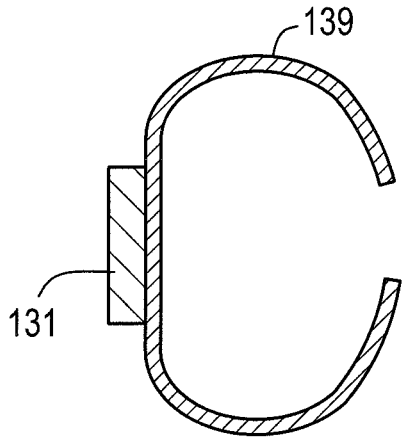

FIG. 13 is a schematic cross-sectional illustration showing a body-engaging assembly that comprises:

a body-engaging element 139; and a first magnet-adhering element (in the form of a first metal plate 131).

As shown in FIG. 13, the first metal plate 131 is attached to the body-engaging element 139.

As discussed above, the expression "body-engaging element," as used herein, encompasses any article that can be engaged to (and optionally disengaged from) a body (e.g., a human body, or a body of any animal or living thing), e.g., a bracelet, a headband, a helmet, a wristband, an armband, a boot, a knee pad, an anklet, a belt, a necklace, a shoulder harness, etc.

FIG. 26 depicts a body-engaging assembly that is similar to the body-engaging assembly depicted in FIG. 13, except that the body-engaging assembly depicted in FIG. 26 extends all the way around an internal space, e.g., as in the case of a bracelet, a headband, a wristband, an armband, a necklace, etc., and it can be resilient, e.g., elastic.

Any of such body-engaging elements can be of any suitable size to fit the body to which it is designed to be engaged to.

Any of such body-engaging elements can be made of any suitable material, a wide variety of which are well known by and readily available to persons of skill in the art.

As discussed above, in accordance with a fourteenth aspect of the present inventive subject matter, there is provided a kit comprising:

a body-engaging assembly in accordance with the thirteenth aspect of the present inventive subject matter; and at least a first magnetic element.

Figure 14:
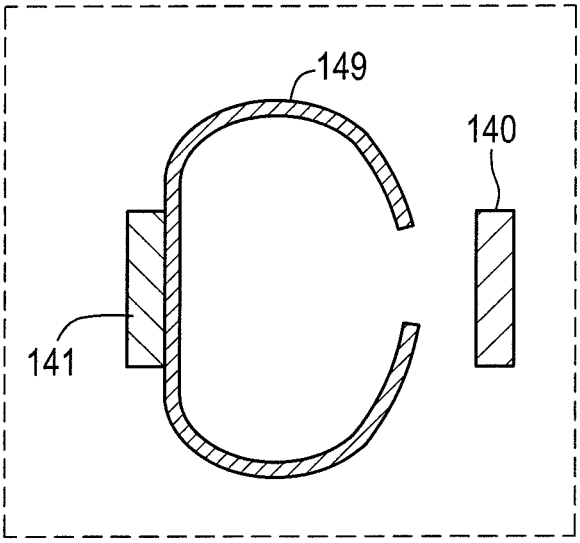

FIG. 14 is a schematic cross-sectional illustration showing a kit that comprises:

a body-engaging element 149;

a first magnet-adhering element (in the form of a first metal plate 141); and a first magnetic element (in the form of a first magnet 140).

As shown in FIG. 14, the first metal plate 141 is attached to the body-engaging element 149.

The discussion above of body-engaging elements (including the disclosure in the discussion relating to the embodiment depicted in FIG. 13) is applicable to the body-engaging element 149.

FIG. 27 depicts a body-engaging assembly that is similar to the body-engaging assembly depicted in FIG. 14, except that the body-engaging assembly depicted in FIG. 27 extends all the way around an internal space, e.g., as in the case of a bracelet, a headband, a wristband, an armband, a necklace, etc., and it can be resilient, e.g., elastic.

The kit can further comprise packaging, e.g., packaging in which the components of the kit are held. For example, the kit depicted in FIG. 14 can further comprise packaging that defines a space having a volume that is not more than 10% greater (or not more than 5% greater, or not more than 15% greater, or not more than 20% greater, or not more than 25% greater, or not more than 30% greater, or not more than 40% greater, or not more than 50% greater) than the sum of the respective volumes of the components in the kit.

As discussed above, in accordance with a fifteenth aspect of the present inventive subject matter, there is provided a magnetically positioned magnet assembly, comprising:

a body-engaging assembly in accordance with the thirteenth aspect of the present inventive subject matter; and at least a first magnetic element, the first magnetic element magnetically adhered to the first magnet-adhering element.

Figure 15:
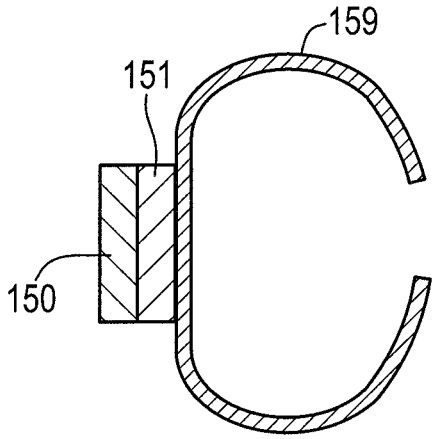

FIG. 15 is a schematic cross-sectional illustration showing a magnetically positioned magnet assembly that comprises:

a body-engaging element 159;

a first magnet-adhering element (in the form of a first metal plate 151); and a first magnetic element (in the form of a first magnet 150).

As shown in FIG. 15, the first metal plate 151 is attached to the body-engaging element 159, and the first magnet 150 is magnetically adhered to the first metal plate 151.

The discussion above of body-engaging elements (including the disclosure in the discussion relating to the embodiment depicted in FIG. 13) is applicable to the body-engaging element 159.

FIG. 28 depicts a body-engaging assembly that is similar to the body-engaging assembly depicted in FIG. 15, except that the body-engaging assembly depicted in FIG. 28 extends all the way around an internal space, e.g., as in the case of a bracelet, a headband, a wristband, an armband, a necklace, etc., and it can be resilient, e.g., elastic.

As discussed above, in accordance with a sixteenth aspect of the present inventive subject matter, there is provided a device assembly, comprising:

a magnetically positioned magnet assembly in accordance with the fifteenth aspect of the present inventive subject matter;

a second magnet-adhering element; and a device, the device attached to the second magnet-adhering element, the second magnet-adhering element magnetically adhered to the first magnetic element.

Figure 16:
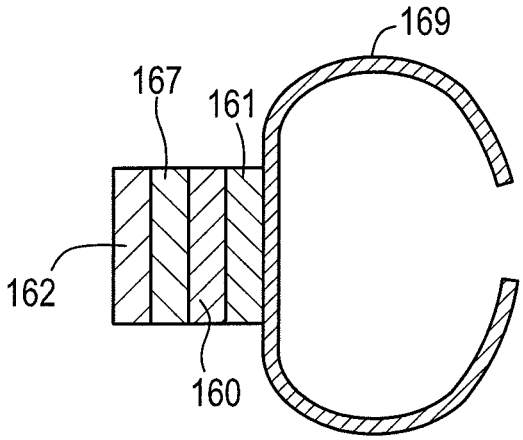

FIG. 16 is a schematic cross-sectional illustration showing a device assembly that comprises:

a body-engaging element 169;

a first magnet-adhering element (in the form of a first metal plate 161);

a first magnetic element (in the form of a first magnet 160);

a second magnet-adhering element (in the form of a second metal plate 167); and a device (in the form of a smart phone 162).

As shown in FIG. 16, the first metal plate 161 is attached to the body-engaging element 169, the first magnet 160 is magnetically adhered to the first metal plate 161, the smart phone 162 is attached to the second metal plate 167, and the second metal plate is magnetically adhered to the first magnet 160.

The discussion above of body-engaging elements (including the disclosure in the discussion relating to the embodiment depicted in FIG. 13) is applicable to the body-engaging element 169.

FIG. 29 depicts a body-engaging assembly that is similar to the body-engaging assembly depicted in FIG. 16, except that the body-engaging assembly depicted in FIG. 29 extends all the way around an internal space, e.g., as in the case of a bracelet, a headband, a wristband, an armband, a necklace, etc., and it can be resilient, e.g., elastic.

As discussed above, in accordance with a seventeenth aspect of the present inventive subject matter, there is provided a body-engaging assembly, comprising:

a body-engaging element; and at least a first magnetic element, the first magnetic element attached to the body-engaging element.

Figure 17:
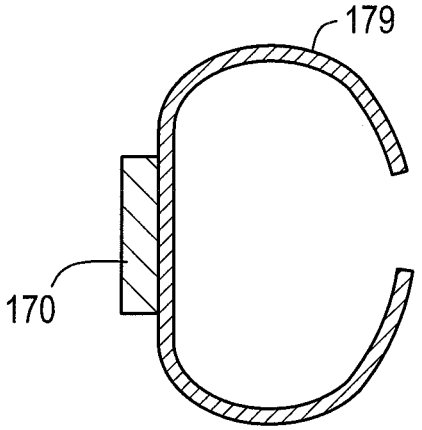

FIG. 17 is a schematic cross-sectional illustration showing a body-engaging assembly that comprises:

a body-engaging element 179; and a first magnetic element (in the form of a first magnet 170).

As shown in FIG. 17, the first magnet 170 is attached to the body-engaging element 179.

The discussion above of body-engaging elements (including the disclosure in the discussion relating to the embodiment depicted in FIG. 13) is applicable to the body-engaging element 179.

FIG. 30 depicts a body-engaging assembly that is similar to the body-engaging assembly depicted in FIG. 17, except that the body-engaging assembly depicted in FIG. 30 extends all the way around an internal space, e.g., as in the case of a bracelet, a headband, a wristband, an armband, a necklace, etc., and it can be resilient, e.g., elastic.

As discussed above, in accordance with an eighteenth aspect of the present inventive subject matter, there is provided a device assembly comprising:

a body-engaging assembly in accordance with the seventeenth aspect of the present inventive subject matter;

at least a first magnet-adhering element; and a device, the device attached to the first magnet-adhering element, the first magnet-adhering element magnetically adhered to the first magnetic element.

Figure 18:
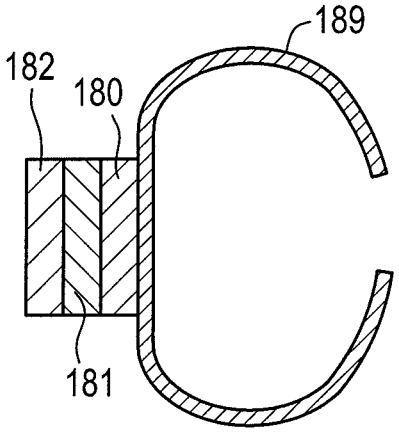

FIG. 18 is a schematic cross-sectional illustration showing a device assembly that comprises:

a body-engaging element 189;

a first magnetic element (in the form of a first magnet 180);

a first magnet-adhering element (in the form of a first metal plate 181); and a device (in the form of a smart phone 182).

As shown in FIG. 18, the first magnet 180 is attached to the body-engaging element 189, the smart phone 182 is attached to the first metal plate 181, and the first metal plate 181 is magnetically adhered to the first magnet 180.

The discussion above of body-engaging elements (including the disclosure in the discussion relating to the embodiment depicted in FIG. 13) is applicable to the body-engaging element 189.

FIG. 31 depicts a body-engaging assembly that is similar to the body-engaging assembly depicted in FIG. 18, except that the body-engaging assembly depicted in FIG. 31 extends all the way around an internal space, e.g., as in the case of a bracelet, a headband, a wristband, an armband, a necklace, etc., and it can be resilient, e.g., elastic.

As discussed above, in accordance with a nineteenth aspect of the present inventive subject matter, there is provided a magnet assembly, comprising:

a magnetic element; and a non-magnetic, non-magnet-adhering element, the non-magnetic, non-magnet-adhering element attached to the magnetic element, at least a first portion of the non-magnetic, non-magnet-adhering element extending at least 1 centimeter away from the magnetic element.

The expression "at least a first portion of the non-magnetic, non-magnet-adhering element extending at least 1 centimeter away from the magnetic element" means that by gentle pulling (e.g., exertion of not more than ten pounds of force), a portion of the non-magnet-adhering element can be extended to a location that is spaced from the magnetic element by at least 1 centimeter, i.e., to a location in which the nearest point of the magnetic element is at least 1 centimeter away.

Figure 19A:
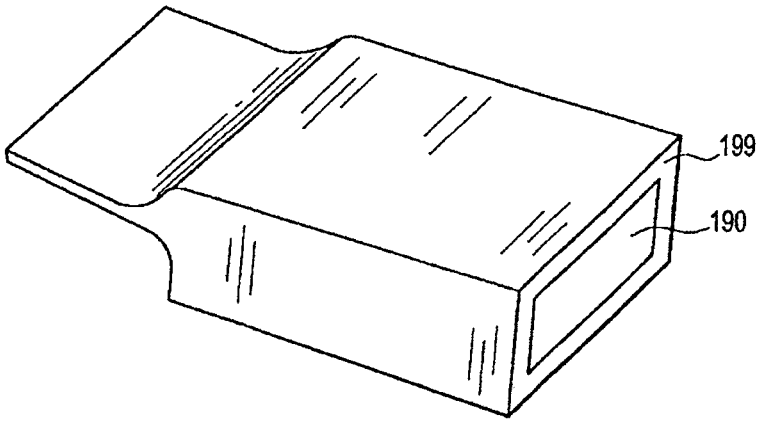
FIG. 19B shows (in dotted lines) the non-visible extremities of the magnet 190 in FIG. 19A.

FIG. 19A is a schematic illustration showing a magnet assembly that comprises:

a magnetic element (in the form of a magnet 190); and a non-magnetic, non-magnet adhering element 199.

As shown in FIG. 19A, the non-magnetic, non-magnet adhering element 199 is attached to the magnet 190.

Figure 19B:
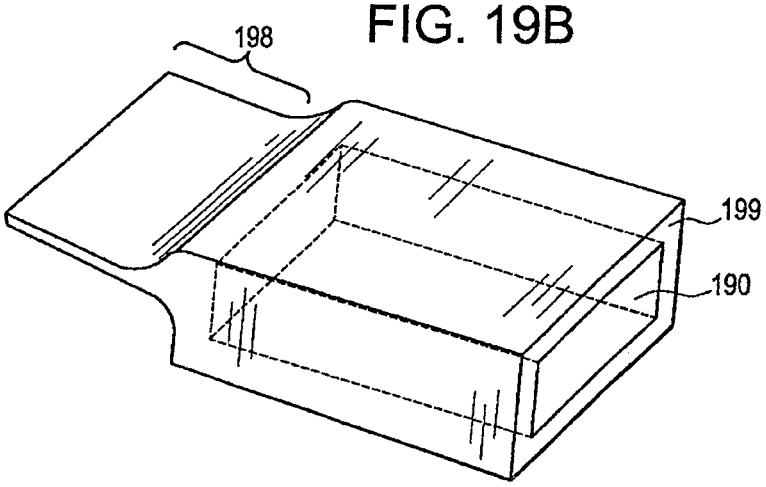

The magnet 190 is orthorhombic and rectangular. The right end (in the orientation depicted in FIG. 19A) of the magnet 190 is visible, and the left end of the magnet 190 (in the orientation depicted in FIG. 19A) is enveloped in the non-magnetic, non-magnet adhering element 199. FIG. 19B is identical to FIG. 19A, except FIG. 19B shows the non-visible extremities of the magnet 190 in dotted lines. As seen in FIGS. 19A and 19B, the non-magnetic, non-magnet adhering element 199 extends beyond the left (in the orientation depicted in FIGS. 19A and 19B) end of the magnet 190, so as to provide a gripping portion 198 on the left (in the orientation depicted in FIGS. 19A and 19B) end of the magnet assembly.

The non-magnetic, non-magnet-adhering element can comprise, consist essentially of or consist of any material (or materials) that is/are non-magnetic (i.e., that does not create a substantial magnetic field) and that is/are not magnetically attracted by a magnet to a significant degree (i.e., that does not contain a significant amount of ferromagnetic material, e.g., iron, nickel or cobalt).

The non-magnetic, non-magnet-adhering element in the magnet assemblies in accordance with the nineteenth aspect of the present inventive subject matter provides an element that a user can grasp and exert leverage to remove the magnetic element (i.e., the magnetic element in the same magnet assembly as the non-magnetic, non-magnet-adhering element) from a magnet-adhering element and/or from a magnetic element (i.e., to remove the magnetic element from another element to which it is magnetically adhered). Likewise, each of two or more magnetic elements can comprise non-magnetic, non-magnet-adhering elements to assist in separating the magnetic elements from one another (e.g., in embodiments that have two or more magnetic elements); similarly, one or more non-magnetic, non-magnet-adhering elements can be provided on any of one or more magnetic elements in any combination of one or more magnetic elements and one or more magnet-adhering elements.

A non-magnetic, non-magnet-adhering element can comprise any suitable non-magnetic and non-magnet adhering material. One representative example of a suitable material is duct tape, e.g., duct tape that has adhesive on one side and optionally has texture (e.g., surface irregularities) on the other side, e.g., camouflage tape.

As noted above, in some embodiments of magnet assemblies in accordance with the nineteenth aspect of the present inventive subject matter, non-magnetic, non-magnet-adhering element can extend around the magnetic element. For example, tape (or other non-magnet, non-magnet-adhering material) can be wrapped around a magnetic element, as in FIGS. 19A and 19B.

In some embodiments in accordance with the nineteenth aspect of the present inventive subject matter, the non-magnet-adhering element can extend more than 1 centimeter away from the magnetic element, e.g., at least 2 centimeters, at least 3 centimeters, at least 4 centimeters, at least 5 centimeters, at least 7 centimeters, at least 10 centimeters, etc.

The left-most (in the orientation depicted in FIGS. 19A and 19B) edge of the non-magnetic, non-magnet-adhering element 199 extends more than 1 centimeter away from the magnet 190. The gripping portion 198 is more than 1 centimeter in length.

A magnet assembly in accordance with the nineteenth aspect of the present inventive subject matter can be employed as a magnetic element (or as magnetic elements) in any of the subject matter disclosed herein, e.g., any of the aspects described herein, any of the embodiments described herein, and any other subject matter described herein.

As discussed above, in accordance with a twentieth aspect of the present inventive subject matter, there is provided a clothing assembly, comprising:

an article of clothing; and
at least a first magnetic element,
the first magnetic element attached to the article of clothing.

As noted above, the expression "attached," as used herein, means that a device or component that is "attached" to a second device or component can be rigidly attached to the second device or component, frictionally attached to the second device or component, surrounded (partially or completely) by the second device or component, or otherwise prevented from being separated from the second device or component, e.g., by being glued, bolted, screwed, riveted, etc., to the second device or component.

In the context of the twentieth aspect of the present inventive subject matter, any suitable type of attachment can be used. One example of a suitable type of attachment of a magnetic element to an article of clothing is for the magnetic element to be stitched into the article of clothing, e.g., for the magnetic element to be surrounded (in some cases, relatively tightly) by threading. The expression "surrounded" encompasses partially surrounded and completely surrounded (i.e., completely surrounded refers to where at least some portion of the article of clothing to each side of the magnetic element, and there can be openings, e.g., between threads of a fabric out of which the article of clothing is made, on some or all sides), e.g., a magnet that is free to move in any direction within an article of clothing by a distance that is not more than 50% of the largest dimension of the magnet (or in some cases not more than 40% of the largest dimension of the magnet, not more than 30% of the largest dimension of the magnet, not more than 20% of the largest dimension of the magnet, or not more than 10% of the largest dimension of the magnet).

Figure 20:
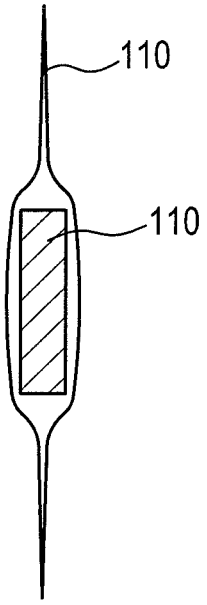
FIG. 20 is a schematic cross-sectional illustration showing a clothing assembly that comprises.

FIG. 20 is a schematic cross-sectional illustration showing a clothing assembly that comprises:

an article of clothing 205; and
at least a first magnetic element (in the form of a first magnet 200).

As shown in FIG. 20, the first magnet 200 is attached to the article of clothing 205 as a result of being surrounded (on all sides) by fabric of the clothing 205.

As discussed above, in accordance with a twenty-first aspect of the present inventive subject matter, there is provided a device assembly comprising:

a clothing assembly in accordance with the twentieth aspect of the present inventive subject matter;
a magnet-adhering element; and
a device,
the device attached to the magnet-adhering element,
the magnet-adhering element magnetically adhered to the first magnetic element.

FIG. 21 is a schematic cross-sectional illustration showing a clothing assembly that comprises:

an article of clothing 215;
at least a first magnetic element (in the form of a first magnet 210);
a magnet-adhering element (in the form of a metal plate 211); and
a device (in the form of a smart phone 212).

As shown in FIG. 21, the first magnet 210 is attached to the article of clothing 215 as a result of being surrounded (on all sides) by fabric of the clothing 215, the metal plate 211 is magnetically adhered to the first magnet 210, and the smart phone 212 is attached to the metal plate 211.

As discussed above, in accordance with a twenty-second aspect of the present inventive subject matter, there is provided a clothing assembly, comprising:

an article of clothing; and
at least a first magnet-adhering element,
the first magnet-adhering element attached to the article of clothing.

As noted above, the expression "attached," as used herein, means that a device or component that is "attached" to a second device or component can be rigidly attached to the second device or component, frictionally attached to the second device or component, surrounded (partially or completely) by the second device or component, or otherwise prevented from being separated from the second device or component, e.g., by being glued, bolted, screwed, riveted, etc., to the second device or component.

In the context of the twenty-second aspect of the present inventive subject matter, any suitable type of attachment can be used. One example of a suitable type of attachment of a first magnet-adhering element to an article of clothing is for the magnet-adhering element to be stitched into the article of clothing, e.g., for the magnet-adhering element to be surrounded (in some cases, relatively tightly) by threading. The expression "surrounded" encompasses partially surrounded and completely surrounded (i.e., completely surrounded refers to where at least some portion of the article of clothing to each side of the magnet-adhering element, and there can be openings, e.g., between threads of a fabric out of which the article of clothing is made, on some or all sides), e.g., a magnet-adhering element that is free to move in any direction within an article of clothing by a distance that is not more than 50% of the largest dimension of the magnet-adhering element (or in some cases not more than 40% of the largest dimension of the magnet-adhering element, not more than 30% of the largest dimension of the magnet-adhering element, not more than 20% of the largest dimension of the magnet-adhering element, or not more than 10% of the largest dimension of the magnet-adhering element).

FIG. 33 is a schematic cross-sectional illustration showing a clothing assembly that comprises:

an article of clothing 335; and at least a first magnet-adhering element (in the form of a first metal plate 331).

As discussed above, in accordance with a twenty-third aspect of the present inventive subject matter, there is provided a magnetically-positioned magnet assembly, comprising:

a clothing assembly in accordance with the twenty-second aspect of the present inventive subject matter; and at least a first magnetic element, the first magnetic element magnetically adhered to the first magnet-adhering element.

FIG. 34 is a schematic cross-sectional illustration showing a clothing assembly that comprises:

an article of clothing 345;

a first magnet-adhering element (in the form of a first metal plate 341); and at least a first magnetic element (in the form of a first magnet 340).

As shown in FIG. 34, the first metal plate 341 is attached to the article of clothing 345 as a result of being surrounded (on all sides) by fabric of the clothing 345, and the first magnet 340 is magnetically adhered to the first metal plate 341.

As discussed above, in accordance with a twenty-fourth aspect of the present inventive subject matter, there is provided a device assembly, comprising:

a magnetically-positioned magnet assembly in accordance with the twenty-third aspect of the present inventive subject matter;

a second magnet-adhering element; and a device, the device attached to the second magnet-adhering element, the second magnet-adhering element magnetically adhered to the first magnetic element.

FIG. 35 is a schematic cross-sectional illustration showing a clothing assembly that comprises:

an article of clothing 355;

a first magnet-adhering element (in the form of a first metal plate 351);

at least a first magnetic element (in the form of a first magnet 350);

a second magnet-adhering element (in the form of a second metal plate 357); and a device (in the form of a smart phone 352).

As shown in FIG. 35, the first metal plate 351 is attached to the article of clothing 355 as a result of being surrounded (on all sides) by fabric of the clothing 355, the first magnet 350 is magnetically adhered to the first metal plate 351, the second metal plate 357 is magnetically adhered to the first magnet 350, and the smart phone 352 is attached to the second metal plate 357.

As noted above, in any method or device in which one or more magnetic element is described herein, two or more magnetic elements can be used in place of any individual magnetic element described herein.

FIG. 36 is a schematic cross-sectional illustration showing a first magnetic element (in the form of a first magnet 360), a second magnetic element (in the form of a second magnet 366), a third magnetic element (in the form of a third magnet 360'), a fourth magnetic element (in the form of a fourth magnet 366'). As shown in FIG. 36, the second magnet 366 is in a pocket (namely, a shirt pocket 364), near the bottom of the pocket, of an article of clothing (in the form of a shirt 365) and the first magnet 360 is outside the pocket, such that a portion of the article of clothing 365 is between the first magnet 360 and the second magnet 366, with the first magnet 360 magnetically adhered to the second magnet 366. Similarly, the fourth magnet 366' is in the shirt pocket 364 (near the top) of the shirt 365, and the third magnet 360' is outside the pocket, such that a portion of the article of clothing 365 is between the third magnet 360' and the fourth magnet 366', with the third magnet 360' magnetically adhered to the fourth magnet 366'. A magnet-adhering element (in the form of a metal plate 361) is magnetically adhered to the first magnet 360 and the third magnet 360', and a device (in the form of a smart phone 362) is attached to the metal plate 361. The metal plate 361 and the smart phone 362 are attached to one another by virtue of the smart phone 362 being frictionally fitted in a case 363 and the metal plate 361 being glued to the back side of the case 363 (or the metal plate 361 being in a pocket on the back side of the case 363, or in grooves on the back side of the case 363, etc.).

In an analogous way, any of the other magnetic elements described herein can be replaced with any number of magnetic elements, e.g., any of the magnetic elements depicted in any of FIG. 1, 3-5, 8-12, 14-21, 27-31, 34, 35, 41, 43, 46, 47-49 or 51-53 can comprise two or more magnetic elements.

As noted above, the present inventive subject matter also provides methods of positioning a device relative to a surface such as a mirror, a tiled structure, a piece of glass, or any other relatively smooth surface, the methods including adhering an attachment element that comprises at least one suction element (e.g. one or more suction cups) or a releasable adhesive material, and the present inventive subject matter also provides positioned devices, in which the positioning of a device is achieved through the use of an attachment element as described above.

FIG. 41 depicts an attachment element assembly 410 that comprises a first attachment element (in the form of a first suction cup 411) and a first magnetic element (in the form of a first magnet 412) attached to the first attachment element.

FIG. 42 depicts an attachment assembly 420 that comprises a first attachment element (in the form of a first layer of releasable adhesion material 421) and a first magnet-adhering element (in the form of a first metal plate 423) attached to the first attachment element.

FIG. 43 depicts an attachment assembly 430 that comprises a first attachment element (in the form of a first suction cup 431), a first magnet-adhering element (in the form of a first metal plate 433) attached to the first attachment element, and a first magnetic element (in the form of a first magnet 432) magnetically adhered to the first attachment element.

FIG. 44 depicts a device assembly 440 that comprises case 444, a first magnet-adhering element (in the form of a first metal plate 443) and a device (in the form of a smart phone 447). The first metal plate 443 and the smart phone 447 are attached to one another by virtue of the smart phone 447 being frictionally fitted in the case 444 and the first metal plate 443 being glued to the back side of the case 444 (or frictionally fit into grooves on the back side of the case 444, or held in a pocket on the back side of the case 444).

FIG. 45 depicts a device assembly 450 that comprises case 454, a first magnet-adhering element (in the form of a first metal plate 453) and a device (in the form of a smart phone 457). The first metal plate 453 and the smart phone 457 are attached to one another by virtue of the smart phone 457 being frictionally fitted in the case 454 and the first metal plate 453 being between the smart phone 457 and the back side of the case 454.

FIG. 46 depicts a device assembly 460 that comprises case 464, a first magnet-adhering element (in the form of a first metal plate 463), a magnet element (in the form of a magnet 465) and a device (in the form of a smart phone 467). The first metal plate 463 and the smart phone 467 are attached to one another by virtue of the smart phone 467 being frictionally fitted in the case 464 and the first metal plate 463 being glued to the back side of the case 464 (or frictionally fit into grooves on the back side of the case 464, or held in a pocket on the back side of the case 464).

FIG. 47 depicts a device assembly 470 that comprises case 474, a first magnet-adhering element (in the form of a first metal plate 473), a magnet element (in the form of a magnet 475) and a device (in the form of a smart phone 477). The first metal plate 473 and the smart phone 477 are attached to one another by virtue of the smart phone 477 being frictionally fitted in the case 474 and the first metal plate 473 being between the smart phone 477 and the back side of the case 474.

A first representative embodiment in accordance with the twenty-fifth aspect of the present inventive subject matter comprises:

adhering to a first surface the first suction cup 411 of the attachment assembly 410 depicted in FIG. 41; and magnetically adhering to the first magnet 412 the first metal plate 443 of the device assembly 440 depicted in FIG. 44.

A second representative embodiment in accordance with the twenty-fifth aspect of the present inventive subject matter comprises:

adhering to a first surface the first suction cup 431 of the attachment assembly 430 depicted in FIG. 43; and magnetically adhering to the first magnet 432 the first metal plate 443 of the device assembly 440 depicted in FIG. 44.

The twenty-fifth aspect of the present inventive subject matter encompasses embodiments in which said "magnetically adhering a device assembly to the attachment assembly" occurs before, after, or simultaneously with said "adhering at least a first attachment element of an attachment assembly to a first surface."

A third representative embodiment in accordance with the twenty-fifth aspect of the present inventive subject matter comprises:

adhering to a first surface the first layer of releasable adhesion material 421 of the attachment assembly 420 depicted in FIG. 42; and magnetically adhering to the first metal plate 423 the first magnet 475 of the device assembly 470 depicted in FIG. 47.

A fourth representative embodiment in accordance with the twenty-fifth aspect of the present inventive subject matter comprises:

adhering to a first surface the first suction cup 411 of the attachment assembly 410 depicted in FIG. 41; and magnetically adhering to the magnet 412 the first magnet 475 of the device assembly 470 depicted in FIG. 47.

A fifth representative embodiment in accordance with the twenty-fifth aspect of the present inventive subject matter comprises:

adhering to a first surface the first suction cup 431 of the attachment assembly 430 depicted in FIG. 43; and magnetically adhering to the magnet 432 the first magnet 475 of the device assembly 470 depicted in FIG. 47.

A first representative embodiment in accordance with the twenty-sixth aspect of the present inventive subject matter comprises:

the magnetic element assembly 410 depicted in FIG. 41; and the device assembly 440 depicted in FIG. 44, with the first metal plate 443 magnetically adhered to the first magnet 412.

A second representative embodiment in accordance with the twenty-sixth aspect of the present inventive subject matter comprises:

the magnetic element assembly 430 depicted in FIG. 43; and the device assembly 440 depicted in FIG. 44, with the first metal plate 443 magnetically adhered to the first magnet 432.

A third representative embodiment in accordance with the twenty-sixth aspect of the present inventive subject matter comprises:

the magnet-adhering element assembly 420 depicted in FIG. 42; and the device assembly 470 depicted in FIG. 47, with the first magnet 475 magnetically adhered to the first metal plate 423.

A fourth representative embodiment in accordance with the twenty-sixth aspect of the present inventive subject matter comprises:

the magnetic element assembly 410 depicted in FIG. 41; and the device assembly 470 depicted in FIG. 47, with the first magnet 475 magnetically adhered to the magnet 412.

A fifth representative embodiment in accordance with the twenty-sixth aspect of the present inventive subject matter comprises:

the magnetic element assembly 430 depicted in FIG. 43; and the device assembly 470 depicted in FIG. 47, with the first magnet 475 magnetically adhered to the magnet 432.

The attachment assemblies depicted in FIGS. 41-43, 48, 49, 51 and 52 are in accordance with the twenty-seventh aspect of the present inventive subject matter.

FIG. 48 depicts a kit 480 that comprises an attachment assembly and a case assembly. The attachment assembly comprises an attachment element 481 (in the form of a first suction cup 481) and a first interface element 482 attached to the attachment element 481. The case assembly comprises a case 484 and a magnet-adhering element 483 attached to the case 484. The first interface element 482 can be at least one magnetic element, a magnet-adhering element or a group of components comprising at least one magnetic element and a magnet-adhering element.

FIG. 49 depicts a kit 490 that comprises an attachment assembly, a case assembly and at least a first magnetic element 492. The attachment assembly comprises a first attachment element (in the form of a first suction cup 491) and a first interface element 493 attached to the first attachment element. The case assembly comprises a case 494 and a first magnet-adhering element (in the form of a second metal plate 496) attached to the case 494. The first interface element 493 can be at least one magnetic element, a magnet-adhering element or a group of components comprising at least one magnetic element and a magnet-adhering element.

FIG. 50 depicts an attachment element 500 that comprises a suction cup region 501 and a loop region 509 in which a magnetic element or a magnet-adhering element can be held in place frictionally and by a compression force (e.g., by the loop region being resilient and defining an opening that is smaller than a cross-sectional area of the magnetic element or the magnet-adhering element). The loop region 509 can be attached to the suction cup region 501 by any suitable attaching element (e.g., one or more rivets, one or more staples, one or more screws, etc., or the attachment element 500 can be a one-piece integral structure.

FIG. 51 depicts an attachment assembly 510 that comprises a first attachment element (comprising a suction cup region 511 and a loop region 519) and a first magnetic element (in the form of a first magnet 512) attached to the first attachment element by virtue of being held by friction and by a compression force exerted by the loop region 519.

FIG. 52 depicts an attachment assembly removably adhered to a surface (in the form of a mirror 528). The attachment assembly comprises a first attachment element (in the form of a first suction cup 521) and a first magnetic element (in the form of a first magnet 522) attached to the first attachment element.

A representative embodiment of a magnetic element assembly in accordance with the thirtieth aspect of the present inventive subject matter is depicted in FIG. 53. The magnetic element assembly comprises a clip assembly 531 and a first magnetic element (in the form of a magnet 532). The magnetic element assembly depicted in FIG. 53 is shown being supported on an opening-defining 533 portion of a pocket 534 attached to an article of clothing 535.

Any of the straps or body-engaging elements described herein (in aspects and in embodiments) can be worn inside or outside a user's clothing, and/or can be worn inside one or more article(s) of clothing and outside one or more other article(s) of clothing, and/or a first portion of a strap or a body-engaging element can be inside an article of clothing and a second portion of the strap or body-engaging element can be outside an article of clothing.

Any of the body-engaging elements described herein (in aspects and in embodiments) can be stretchable (e.g., resilient), can be annular, can be stretchable annular (e.g., a resilient headband, a resilient necklace, a resilient wristband, etc.) can be bendable (e.g., can be bent to engage with a user's body or a portion of a user's body (e.g., a limb) and bent again to be removed from the body or portion of the body.

A friction-enhancing member (or two or more friction-enhancing members) as described in the description of the sixth aspect of the present inventive subject matter can be employed in any embodiment described herein, in connection with any aspect in which a friction-enhancing member would be suitable. For example, a friction-enhancing member can be attached to a magnet-adhering element (to which a device is attached) to assist in holding the magnet-adhering element (and the attached device) in place when it is magnetically adhered to any magnetic element. Similarly, a friction-enhancing member can be attached to a first magnetic element to assist in holding the first magnetic element in place relative to a second magnetic element, or a friction-enhancing member can be attached to a magnetic element to assist in holding it in place relative to a magnet-adhering element.

Below are a series of numbered passages, each of which defines subject matter within the scope of the present inventive subject matter:

Passage 1. A method of positioning a device, comprising:

adhering at least a first attachment element of an attachment assembly to a first surface, and magnetically adhering a device assembly to the attachment assembly, the attachment assembly comprising at least the first attachment element and at least a first interface element, the first interface element selected from the group consisting of [1] at least one magnetic element and [2] at least one magnet-adhering element, the first interface element attached to the first attachment element, the first attachment element selected from the group consisting of [3] at least one suction element and [4] at least one releasable adhesive material, the device assembly comprising at least a first magnet-adhering element and a device, the device attached to the first magnet-adhering element.

Passage 2. A method as recited in passage 1, wherein the first interface element is a first magnetic element.

Passage 3. A method as recited in passage 1, wherein:

the first interface element is a second magnet-adhering element, and the method further comprises magnetically adhering at least one magnetic element to the second magnet-adhering element.

Passage 4. A method as recited in passage 1, wherein:

the first interface element is a second magnet-adhering element, and the method further comprises magnetically adhering at least one magnetic element to the first magnet-adhering element.

Passage 5. A method as recited in passage 1, wherein:

the first interface element is a second magnet-adhering element, the attachment assembly further comprises at least a first magnetic element, the method further comprises magnetically adhering at least a second magnetic element to the first magnet-adhering element.

Passage 6. A method as recited in passage 1, wherein the method further comprises magnetically adhering at least a first magnetic element to the first magnet-adhering element.

Passage 7. A method as recited in passage 1, wherein:

the first interface element is a first magnetic element, and the method further comprises magnetically adhering at least a second magnetic element to the first magnet-adhering element.

Passage 8. A method as recited in passage 1, wherein the first magnet-adhering element is attached to a case by at least one of [1] being glued to the case, [2] being frictionally fit into grooves on the case, [3] being held in a pocket on the case, or [4] being between the device and the case.

Passage 9. A method as recited in passage 1, wherein the attachment assembly comprises a plurality of attachment elements.

Passage 10. A method as recited in passage 1, wherein the first surface comprises an element selected from the group consisting of a mirror, a tile or a glass structure.

Passage 11. A positioned device, comprising:

an attachment assembly, and a device assembly, the attachment assembly comprising at least a first attachment element and at least a first interface element, the first interface element selected from the group consisting of [1] at least one magnetic element and [2] at least one magnet-adhering element, the first interface element attached to the first attachment element, the first attachment element selected from the group consisting of [3] at least one suction element and [4] at least one releasable adhesive material, the device assembly magnetically adhered to the attachment assembly, the device assembly comprising at least a first magnet-adhering element and a device, the device attached to the first magnet-adhering element.

Passage 12. A positioned device as recited in passage 11, wherein the first interface element is a first magnetic element.

Passage 13. A positioned device as recited in passage 11, wherein:

the first interface element is a second magnet-adhering element, and the attachment assembly further comprises at least one magnetic element magnetically adhered to the second magnet-adhering element.

Passage 14. A positioned device as recited in passage 11, wherein:

the first interface element is a second magnet-adhering element, and the device assembly further comprises at least one magnetic element magnetically adhered to the first magnet-adhering element.

Passage 15. A positioned device as recited in passage 11, wherein:

the first interface element is a second magnet-adhering element, the attachment assembly further comprises at least a first magnetic element magnetically adhered to the second magnet-adhering element, the device assembly further comprises at least a second magnetic element magnetically adhered to the first magnet-adhering element.

Passage 16. A positioned device as recited in passage 11, wherein the device assembly further comprises at least a first magnetic element magnetically adhered to the first magnet-adhering element.

Passage 17. A positioned device as recited in passage 11, wherein:

the first interface element is a first magnetic element, and the device assembly further comprises at least a second magnetic element magnetically adhered to the first magnet-adhering element.

Passage 18. A positioned device as recited in Passage 11, wherein the first magnet-adhering element is attached to a case by at least one of [1] being glued to the case, [2] being frictionally fit into grooves on the case, [3] being held in a pocket on the case, or [4] being between the device and the case.

Passage 19. A positioned device as recited in Passage 11, wherein the attachment assembly comprises a plurality of attachment elements.

Passage 20. A positioned device as recited in Passage 11, wherein the first surface comprises an element selected from the group consisting of a mirror, a tile or a glass structure.

Passage 21. An attachment assembly comprising:

at least a first attachment element, and at least a first interface element, the first interface element selected from the group consisting of [1] at least one magnetic element and [2] at least one magnet-adhering element, the first interface element attached to the first attachment element, the first attachment element selected from the group consisting of [3] at least one suction element and [4] at least one releasable adhesive material.

Passage 22. An attachment assembly as recited in passage 21, wherein the first interface element is a first magnetic element.

Passage 23. An attachment assembly as recited in passage 21, wherein:

the first interface is a second magnet-adhering element, and the attachment assembly further comprises at least one magnetic element magnetically adhered to the second magnet-adhering element.

Passage 24. A kit comprising:

an attachment assembly; and a case assembly, the attachment assembly comprising:

at least a first attachment element; and at least a first magnetic element attached to the first attachment element, the first attachment element comprising at least one member selected from suction elements and releasable adhesive materials, the case assembly comprising:

a case; and at least a first magnet-adhering element attached to the case.

Passage 25. A kit as recited in Passage 24, wherein the kit further comprises a device.

Passage 26. A kit as recited in Passage 24, wherein the kit further comprises at least a second magnetic element.

Passage 27. A kit comprising:

an attachment assembly;

a case assembly; and at least a first magnetic element, the magnet-adhering element assembly comprising:

at least a first attachment element;

at least a first magnet-adhering element attached to the first attachment element, the first attachment element comprising at least one member selected from suction elements and releasable adhesive materials, the case assembly comprising:

a case; and at least a first magnet-adhering element attached to the case.

Passage 28. A kit as recited in Passage 27, wherein the kit further comprises at least a second magnetic element.

Passage 29. A kit as recited in Passage 27, wherein the kit further comprises a device.

Passage 30. A magnetic element assembly, comprising:

a clip assembly that is configured to be supported by an opening-defining portion of a pocket; and at least a first magnetic element attached to the clip assembly.

Passage 31. A device assembly, comprising a magnetic element assembly as recited in Passage 30; and a device assembly, the device assembly comprising a case, a first magnet-adhering element and a device.

Passage 32. A device assembly as recited in Passage 31, wherein the first magnet-adhering element and the device are attached to one another by virtue of the device being frictionally fitted in the case and the first magnet-adhering element being glued to the case, frictionally fit into grooves on the case, or held in a pocket on the case.

Passage 33. A device assembly, comprising a magnetic element assembly as recited in Passage 30; and a device assembly, the device assembly comprising a case, a first magnet-adhering element and a device.

Passage 34. A device assembly as recited in Passage 33, wherein the first magnet-adhering element and the device are attached to one another by virtue of the device being frictionally fitted in the case, and the first magnet-adhering element being between the device and the case.

Passage 35. A device assembly, comprising a magnetic element assembly as recited in Passage 30; and a device assembly, the device assembly comprising a case, a first magnet-adhering element, a magnet element and a device.

Passage 36. A device assembly as recited in Passage 35, wherein the first magnet-adhering element and the device are attached to one another by virtue of the device being frictionally fitted in the case and the first magnet-adhering element being glued to the case, frictionally fit into grooves on the case, or held in a pocket on the case.

Passage 37. A device assembly, comprising a magnetic element assembly as recited in Passage 30; and a device assembly, the device assembly comprising a case, a first magnet-adhering element, a magnet element and a device.

Passage 38. A device assembly as recited in Passage 37, wherein the first magnet-adhering element and the device are attached to one another by virtue of the device being frictionally fitted in the case, and the first magnet-adhering element being between the device and the case.

Embodiments in accordance with the present inventive subject matter have been described above in detail in order to provide exact features of representative embodiments that are within the overall scope of the present inventive subject matter. The present inventive subject matter should be understood to be not limited to such detail. Thus, the devices and components illustrated in the figures are schematic in nature, and their shapes are not intended to illustrate precise shapes of components or devices (or regions thereof), and are not intended to limit the scope of the present inventive subject matter.

Many alterations and modifications may be made by those having ordinary skill in the art, given the benefit of the present disclosure, without departing from the spirit and scope of the inventive subject matter. Therefore, it must be understood that present inventive subject matter encompasses what is encompassed by the present description (and/or the present claims), as well as subject matter that provides similar function, and/or that functions in a similar way and/or that achieves a similar result or results, as well as subject matter that involves minor or insubstantial differences from what is encompassed by the present description. (and/or the present claims).

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Any two or more structural parts of the devices or components described herein can, where logical or appropriate, be integrated, and/or any structural part of the devices or components described herein can, where logical or appropriate, be provided in two or more parts (which can be held together, if necessary). Similarly, any two or more functions can be conducted simultaneously, and/or any function can be conducted in a series of steps.

The invention claimed is:

1. A clip-adhered device assembly, comprising:

a clip assembly that is configured to be supported by an opening-defining portion of a pocket;

at least a first magnetic element attached to the clip assembly; and a device assembly, the device assembly comprising a case, a first magnet-adhering element and a device, the first magnet-adhering element magnetically adhered to the first magnetic element, the case attached to the first magnet-adhering element, the device attached to the case, the first magnet-adhering element and the device attached to one another by virtue of the device being frictionally fitted in the case and the first magnet-adhering element being glued to the case, frictionally fit into grooves on the case, or held in a pocket on the case.

2. A clip-adhered device assembly, comprising:

a clip assembly that is configured to be supported by an opening-defining portion of a pocket;

at least a first magnetic element attached to the clip assembly; and a device assembly, the device assembly comprising a case, a first magnet-adhering element, a magnet element and a device, the magnet element magnetically adhered to the first magnetic element, the first magnet-adhering element magnetically adhered to the first magnetic element, the case attached to the first magnet-adhering element, the device attached to the case, the first magnet-adhering element and the device attached to one another by virtue of the device being frictionally fitted in the case and the first magnet-adhering element being glued to the case, frictionally fit into grooves on the case, or held in a pocket on the case.

* * * * *